US007091938B2

(12) United States Patent
Inukai et al.

(10) Patent No.: US 7,091,938 B2
(45) Date of Patent: Aug. 15, 2006

(54) DISPLAY DEVICE

(75) Inventors: Kazutaka Inukai, Kanagawa (JP); Satoshi Seo, Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 372 days.

(21) Appl. No.: 10/394,062

(22) Filed: Mar. 24, 2003

(65) Prior Publication Data

US 2003/0184505 A1 Oct. 2, 2003

(30) Foreign Application Priority Data

Mar. 26, 2002 (JP) ..... 2002-087223

(51) Int. Cl.
*G09G 3/30* (2006.01)
*G09G 3/32* (2006.01)

(52) U.S. Cl. ..... 345/76; 345/82

(58) Field of Classification Search ..... 345/44–46, 345/76, 82, 83, 204; 257/213–413
See application file for complete search history.

(56) References Cited

U.S. PATENT DOCUMENTS 4,219,828 A * 8/1980 Lardy et al. ..... 257/272
4,917,467 A 4/1990 Chen et al.
5,198,379 A 3/1993 Adan
5,258,325 A 11/1993 Spitzer et al.
5,331,192 A 7/1994 Kudoh
5,637,899 A 6/1997 Eimori et al.
5,986,306 A 11/1999 Nakajima et al.
6,020,598 A 2/2000 Yamazaki
6,246,180 B1 6/2001 Nishigaki
6,501,466 B1 * 12/2002 Yamagishi et al. ..... 345/204
6,583,775 B1 6/2003 Sekiya et al.
2002/0047581 A1 4/2002 Koyama
2002/0047582 A1 4/2002 Inukai et al.
2002/0086180 A1 7/2002 Seo et al.
2002/0113546 A1 8/2002 Seo et al.
2002/0121860 A1 9/2002 Seo et al.

(Continued)

FOREIGN PATENT DOCUMENTS

EP 1 094 436 A2 4/2001

(Continued)

OTHER PUBLICATIONS

Tsutsui et al., "Electroluminescence in Organic Thin Films," Photochemical Processes in Organized Molecular Systems, Sep. 22, 1990, pp. 437-450 (Elsevier Science Publishers, Tokyo, 1991).

(Continued)

*Primary Examiner*—Richard Hjerpe
*Assistant Examiner*—Kevin M. Nguyen
(74) *Attorney, Agent, or Firm*—Nixon Peabody LLP; Jeffrey L. Costellia

(57) ABSTRACT

An EL display device free of a dispersion in the brightness caused by deterioration in the EL elements. The display device uses pixels of the current-controlled type to suppress a change in the current flowing through the EL elements caused by the deterioration in the EL elements. The display device further uses elements capable of short-circuiting or opening three nodes simultaneously. No bank is used for dividing the EL layers into separate colors. EL elements of the mixed junction type are used. A reverse bias voltage is applied to the EL elements at regular intervals. The display device suppresses dispersion in the brightness caused by the deterioration in the EL elements.

27 Claims, 21 Drawing Sheets

U.S. PATENT DOCUMENTS

| | | | |
|---|---|---|---|
| 2002/0139303 | A1 | 10/2002 | Yamazaki et al. |
| 2003/0015960 | A1 | 1/2003 | Seo et al. |
| 2003/0066740 | A1 | 4/2003 | Inukai |
| 2003/0089910 | A1 | 5/2003 | Inukai |
| 2003/0122140 | A1 | 7/2003 | Yamazaki et al. |
| 2004/0012026 | A1 | 1/2004 | Seo et al. |
| 2004/0056257 | A1 | 3/2004 | Sakamoto et al. |

FOREIGN PATENT DOCUMENTS

| | | | |
|---|---|---|---|
| EP | 1 102 324 | A2 | 5/2001 |
| EP | 1 103 946 | A2 | 5/2001 |
| JP | 60-241266 | | 11/1985 |
| JP | 04-092475 | | 3/1992 |
| JP | 04-267551 | | 9/1992 |
| JP | 09-319323 | | 12/1997 |
| JP | 2000-235370 | | 8/2000 |
| JP | 2000-347621 | | 12/2000 |
| JP | 2001-147659 | | 5/2001 |
| JP | 2001-222255 | | 8/2001 |
| WO | WO93/16491 | | 8/1993 |

OTHER PUBLICATIONS

M. A. Baldo et al. "Highly Efficient Phosphorecent Emission from Organic Electroluminescent Devices," Nature, vol. 395, Sep. 10, 1998, pp. 151-154.

M. A. Baldo et al., "Very High-Efficiency Green Organic Light-Emitting Devices Based on Electrophosphorescence," Applied Physics Letters vol. 75, No. 1, Jul 5, 1999, pp. 4-6.

Tsutsui et al., "High Quantum Efficiency in Organic Light-Emitting Devices with Iridium,-Complex as a Triplet Emissive Center," Japanese Journal of Applied Physics, vol. 38, Part 2, No. 12B, Dec. 15, 1999, pp. L1502-L1504.

* cited by examiner

PRIOR ART

FIG.11A
(TA1)
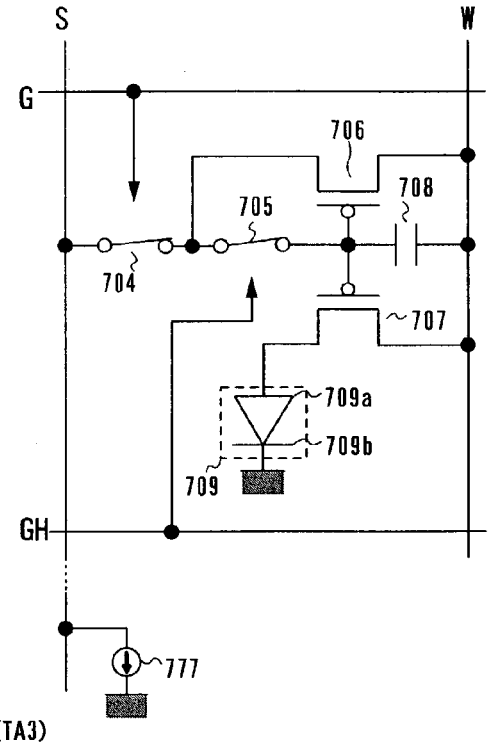
FIG.11B
(TA2)
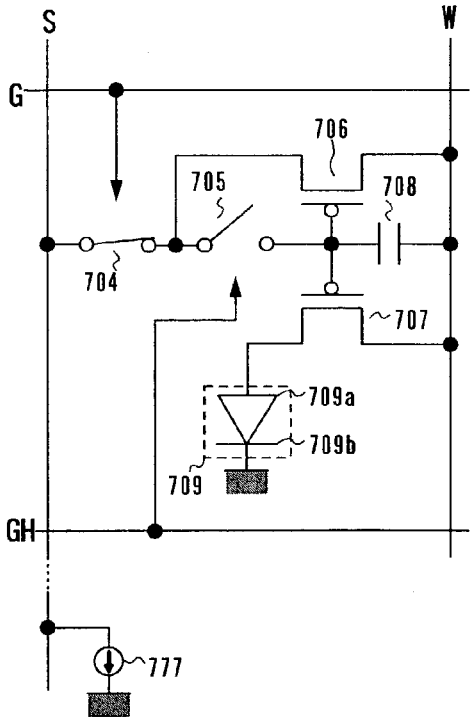
(TA3)
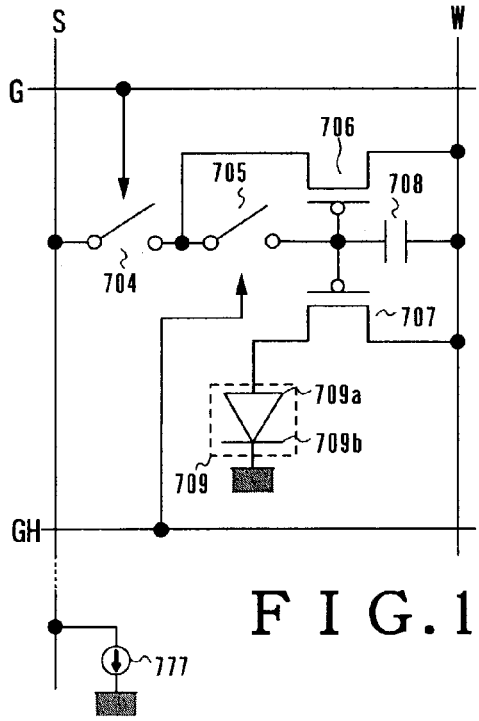
PRIOR ART
FIG.11C

PRIOR ART

DISPLAY DEVICE

BACKGROUND OF THE INVENTION

1. Field of the Invention

The present invention relates to a display device in which a light-emitting element is provided in each of the pixels. In particular, the invention relates to a display device of the active matrix type in which a transistor is provided for each of the pixels to control the emission of light from the light-emitting elements. The invention further relates to electronic devices using the display device.

2. Description of the Related Art

There has been proposed a display device of the active matrix type in which a light-emitting element and a transistor are arranged for each of the pixels to control the emission of light from the light-emitting element. In particular, attention has been given to the display device of the active matrix type using thin-film transistors (hereinafter referred to as TFTs) as transistors.

The light-emitting element has a first electrode and a second electrode, and changes its brightness depending upon the amount of current that flows across the first electrode and the second electrode. As the light-emitting element, attention has been given to an element (referred to as EL element) which utilizes electroluminescence. Attention has been given particularly to a display device (hereinafter referred to as EL display device) using the EL elements (EL element utilizing an organic substance is also referred to as an organic EL element or an OLED (organic light-emitting diode) element (OLE Device, OELD).

Here, the EL element stands for the one having an anode, a cathode and an EL layer held between the anode and the cathode. The anode and the cathode correspond to a first electrode and to a second electrode. Upon applying a voltage across these electrodes, a current flows between the electrodes. The EL element emits light depending upon the amount of electric current that flows.

The EL layer can be constructed in a stacked layer structure. A representative example may be a stacked layer structure "positive hole transporting layer/light-emitting layer/electron transporting layer" proposed by Tang et al. of Kodak Eastman Co. Here, the electron transporting layer is the one made of a material (hereinafter also referred to as electron transporting material) exhibiting a higher electron mobility (electron transporting function) than a positive hole mobility. The light-emitting layer is the one made of a material having light-emitting property (light-emitting function)(hereinafter referred to as light-emitting material). The positive hole transporting layer is the one made of a material (hereinafter referred to as positive hole transporting material) exhibiting a higher positive hole mobility (positive hole transporting function) than an electron mobility. There can be further employed a structure in which positive hole injection layer/positive hole transporting layer/light-emitting layer/electron transporting layer, or positive hole injection layer/positive hole transporting layer/light-emitting layer/electron transporting layer/electron injection layer, are stacked in this order on the anode. The light-emitting layer may be doped with a fluorescent coloring matter. Here, the electron injection layer is the one made of a material (hereinafter referred to as electron injection material) having electron injection property (electron injection function) for receiving electrons from the cathode. Further, the positive hole injection layer is the one made of a material (hereinafter referred to as positive hole injection material) having positive hole injection property (positive hole injection function) for receiving positive holes from the anode. The layers formed between the cathode and the anode are all referred to generally as EL layer. When a predetermined voltage is applied from the pair of electrodes (anode and cathode) to the EL layer having the above structure, carriers undergo the recombination in the EL layer to emit light. The layers held between the anode and the cathode of the EL element are generally described as the EL layer.

The EL display device has such advantages as excellent response characteristics, operates at a low voltage and offers a wide viewing angle, and is drawing attention as a flat panel display of the next generation. In the EL display device of the active matrix type, the method of controlling the brightness of EL elements in-the pixels by flowing a predetermined current between the anode and the cathode of the EL elements, is called current-controlled type.

Described below is a constitution of the pixel of the current-controlled type. Namely, described below is a pixel of the current-controlled type in which the signal lines (source signal lines) of pixels are served with a current signal (hereinafter referred to as signal current) that linearly corresponds to brightness data expressed by a video signal.

Each pixel has a TFT which receives a signal current as a drain current and a capacitor unit for holding a gate voltage of the TFT. Namely, the pixel has a function for converting the input signal current into a voltage (gate voltage) and for holding the voltage. Further, each pixel has a function for converting the voltage stored in the capacitor unit into a current again, and continues to flow the converted current into the EL element even after the signal current is no longer input from the source signal line. The current flowing into the EL element changes upon changing the signal current input to the source signal line, whereby the brightness of the EL element is controlled to express the gray scale.

FIG. 10 illustrates a conventional pixel of the current-controlled type, and its driving method (see, for example, patent literature 1). In FIG. 10, a pixel is constituted by an EL element 709, a select TFT 704, a drive TFT 707, a current TFT 706, a capacitor element (holding capacitor) 708, a holding TFT 705, a source signal line S, a first gate signal line G, a second gate signal line GH and a power line W (Patent literature 1: JP-A-2001-147659).

Either the source terminal or the drain terminal of the TFT is called first terminal, and the other one is called second terminal.

The gate electrode of the select TFT 704 is connected to the first gate signal line G. A first terminal of the select TFT 704 is connected to the source signal line S, and a second terminal is connected to a first terminal of the current TFT 706 and to a first terminal of a holding TFT 705. A second terminal of the current TFT 706 is connected to the power source line W. A second terminal of the holding TFT 705 is connected to one electrode of the holding capacitor 708 and to the gate electrode of the drive TFT 707. The holding capacitor 708 is connected to the power line W on the side that is not connected to the holding TFT 705. The gate electrode of the holding TFT 705 is connected to a second gate signal line GH. The first terminal of the drive TFT 707 is connected to one electrode 709*a* of the EL element 709, and the second terminal thereof is connected to the power line W. Another electrode 709*b* of the EL element 709 is maintained at a predetermined potential. The value of the signal current input to the source signal line S is controlled by a video signal input current source 777. The electrode 709*a* of the EL element 709 is called pixel electrode and another electrode 709*b* is called opposing electrode.

Here, the drive TFT 707 and the current TFT 706 have the same polarity, and it is considered that the Id-Vgs characteristics of the drive TFT 707 are equivalent to the Id-Vgs characteristics of the current TFT 706. There is further illustrated a pixel of a constitution in which the select TFT 704 and the holding TFT 705 are the N-channel TFTs, the drive TFt 707 and the current TFT 706 are the P-channel TFTs, and the pixel electrode 709*a* is the anode.

How to drive the pixel of the constitution of FIG. 10 will now be described with reference to FIGS. 11A–C and 12. In FIGS. 11A–C, the select TFT 704 and the holding TFT 705 are expressed as switches so that their on/off state can be easily understood. The pixel states (TA1) to (TA3) are corresponding to the states of periods TA1 to TA3 in the timing chart of FIG. 12.

In FIG. 12, G-1 and G-2 denote potentials of the first gate signal line G and of the second gate signal line GH. Further, |Vgs| is an absolute value of the gate voltage (gate-source voltage) of the drive TFT 707. $I_{EL}$ denotes a current flowing through the EL element 709, and $I_{video}$ denotes a current determined by the video signal input current source 777.

In the period TA1, the select TFT 704 and the holding TFT 705 are turned on due to signals of the first gate signal line G and of the second gate signal line GH. Thus, the power line W is connected to the source signal line S through the current TFT 706, holding TFT 705 and select TFT 704. The current $I_{video}$ determined by the video signal input current source 777 flows into the source signal line S. When a steady state is assumed after the passage of a sufficient period of time, therefore, the drain current of the current TFT 706 becomes $I_{video}$. Thus, the gate voltage corresponding to the drain current $I_{video}$ of the current TFT 706 is held by the holding capacitor 708. Then, in the period TA2, a signal on the second gate signal line GH changes and the holding TFT 705 is turned off. The drain current $I_{video}$ flows into the drive TFT 707. Thus, the signal current $I_{video}$ flows into the EL element 709 from the power line W through the source and drain of the drive TFT 707. The EL element 709 emits light maintaining a brightness corresponding to the signal current $I_{video}$.

In the constitution shown in FIG. 10, a current flows from the anode 709*a* of the EL element 709 to the cathode 709*b* owing to the above method. When the EL element 709 emits light, the second terminal of the current TFT 706 corresponds to the source terminal, and the first terminal corresponds to the drain terminal. Further, the second terminal of the drive TFT 707 corresponds to the source terminal, and the first terminal corresponds to the drain terminal.

In the next period TA3, the signal on the first gate signal line G changes, and the select TFT 704 is turned off. Even after the select TFT 704 is turned off, the signal current $I_{video}$ continues to flow into the EL element 709 from the power line W through the source and drain of the drive TFT 707, and the EL element 709 continues to emit light.

A series of operations of periods TA1 to TA3 are called signal current $I_{video}$ writing operation. In this case, the signal current $I_{video}$ is varied in an analog manner to change the brightness of the EL element 709 and to express the gray scale.

In the above current-controlled display device, the drive TFT 707 operates in the saturated region. Here, the drain current of the drive TFT 707 is determined by the signal current input from the source signal line S. That is, if the current characteristics are the same between the drive TFT 707 and the current TFT 706 in the same pixel, the drive TFT 707 automatically varies its gate voltage to continuously flow a constant drain current irrespective of dispersion in the threshold voltage and in the mobility.

In the EL element, a relationship (I-V characteristics) between the electric current that flows and the voltage across the anode and the cathode, varies depending upon the environmental temperature at which the EL element is used and upon the deterioration of the EL element. However, the pixel of the current-controlled type is capable of maintaining the current flowing into the EL element nearly constant irrespective of the environmental temperature at which the EL element is used and the deterioration of the EL element.

FIG. 9 illustrates a change in the deterioration of the EL element with the passage of time of when the current flowing into the EL element is maintained constant, and wherein the ordinate represents the brightness L of the EL element and the abscissa represents the time t. A curve 900 represents a change in the brightness of when the current flowing into the EL element is maintained constant. When the time is t0, the brightness L of the EL element is supposed to be 100%. The EL element undergoes the deterioration depending upon the time in which a predetermined current continues to flow. Accordingly, the brightness decreases even while the same current is flowing between the anode and the cathode of the EL element.

In the current-controlled type pixel, therefore, a problem arises concerning the dispersion in the brightness due to deterioration of the EL element.

SUMMARY OF THE INVENTION

The present invention therefore provides a display device capable of emitting light maintaining a nearly constant brightness by lowering a change in the brightness caused by a change in the current characteristics stemming from the deterioration of the EL element.

The display device of the invention employs current-controlled type pixels in order to suppress a change in the current that flows through the EL elements caused by the deterioration of the EL elements.

For example, the pixel of the current-controlled type includes:

an EL element having a first electrode, a second electrode, and an EL layer held between the first electrode and the second electrode;

means for converting a first current input to the pixel into a voltage;

means for holding the voltage; and means for converting the voltage into a second current which flows between the first electrode and the second electrode of the EL element.

In order to suppress the deterioration of the EL element while using the above current-controlled type pixel, at least one method is used in combination therewith out of the following three methods (first method to third method). Thus, deterioration in the EL elements is decreased in a synergistic matter.

First, these three methods will be described and, then, use of these methods in combination will be described from the standpoint of using the current-controlled type pixels.

The first method is to increase the numerical aperture of the pixel. The pixel is designed to possess a large area (hereinafter referred to as light-emitting area) on where the EL element contributes to displaying the image. Upon increasing the light-emitting area, the density of the current flowing into the EL element can be decreased to produce the same brightness. Here, the EL element undergoes the deterioration in proportion to the density of electric current that flows. By increasing the numerical aperture to decrease the current density for emitting light, therefore, deterioration of the EL element can be suppressed.

For this purpose, one or both of the following two constitutions (first constitution and second constitution) are used. The first constitution and the second constitution will be described in order.

According to the first constitution, the elements such as TFTs occupy the pixels at a small ratio. This is because, in the display device of the type which emits light from the EL element through the element such as TFT possessed by the pixel, the area occupied by the element such as TFT possessed by the pixel is decreased to increase the numerical aperture.

The first constitution uses a switching element capable of simultaneously short-circuiting or opening three or more nodes in each pixel as will be described below. Here, a state where a plurality of nodes are short-circuited stands for the one in which an electric connection is made between any two nodes among the plurality of nodes. Further, a state where a plurality of nodes are opened stands for the one in which no electric connection is made between any two nodes among the plurality of nodes.

The switching element of the first constitution will be described in more detail. The switching element includes an active layer formed by a semiconductor thin film on the insulating surface, an insulating film in contact with the active layer, and a gate electrode overlapped on the active layer via the insulating film, and the active layer includes at least one channel-forming region and impurity regions (regions to where impurity element are added) of a number of n (n is a natural number of not smaller than 3). Among the impurity regions of the number of n, the impurity regions of a number of m (m is a natural number of not smaller than 3 but is not larger than n) are in contact with different connection electrodes. The impurity regions of the number of n are in contact with the channel-forming regions.

The impurity regions of the number of n may possess a region (hereinafter referred to as low-concentration impurity region) containing impurities at a concentration lower than that of the impurity regions between themselves and the channel-forming region.

Here, among the impurity regions of the number of m, any two impurity regions are connected together in the active layer through the channel-forming region only. Or, among the impurity regions of the number of m, any two impurity regions are connected to the channel region through the low-concentration impurity region only. Or, among the impurity regions of the number of m, any two impurity regions are connected to the channel region through the impurity regions other than the impurity regions of the number of m among the impurity regions of the number of n. Or, among the impurity regions of the number of m, any two impurity regions are connected to the channel region through the low-concentration impurity region and through the impurity regions other than the impurity regions of the number of m among the impurity regions of the number of n.

The thus constituted switching element (hereinafter also referred to as multi-drain element) is capable of selecting a case where a channel is formed in the channel-forming region and a case where no channel is formed depending upon the potential at the gate electrode. Thus, it is allowed to select a case where any two connection electrodes are rendered conductive and a case where they are rendered nonconductive among the connection electrodes connected to the impurity regions of the number of m. Thus, all connection electrodes can be short-circuited or opened simultaneously. The operation for short-circuiting or opening the three or more nodes can now be carried out by using only one switching element (multi-drain element) that is constituted as described above though it had so far been done by using a plurality of TFTs.

It is thus made possible to decrease the area of the pixel occupied by the element (switching element).

According to the second constitution, when it is so limited that EL element which emit light of different colors are arranged on the pixel portion, the boundaries of the EL layers of the EL elements corresponding to the colors of the emitted light are arranged in an overlapped manner. For example, the EL layer (first EL layer) of the EL element that emits light of a first color and the EL layer (second EL layer) of the EL element that emits light of a second color, are arranged with their ends overlapped one upon the other. Here, in the conventional EL display device, the boundaries are set by a bank formed by the insulator, and the EL layers of the EL elements corresponding to the colors of emitted light are divided into separate colors. According to the second constitution of this invention, on the other hand, the boundaries of the EL layers of the EL elements corresponding to the colors of the emitted light are arranged being overlapped one upon the other to eliminate the bank for dividing into separate colors. With the bank being omitted, the area can be increased in which the EL element contributes to displaying the image.

The second constitution is not limited to the display device of the type which enables the image to be viewed through the element such as TFTs possessed by the pixels. Namely, the second constitution may be applied to the display device of the type which enables the image to be viewed from the side opposite to the substrate on where there are formed elements such as TFTs possessed by the pixels.

In the foregoing was described the first method of increasing the numerical aperture of the pixels and decreasing the density of electric current that flows into the EL elements to obtain the same brightness. Next, described below is the second method.

The second method employs the EL elements which deteriorate little being arranged in the pixels. Constitution of the EL elements will now be described.

The EL layer forming the EL element is not constituted in a stacked layer structure of a positive hole injection layer made of a positive hole injection material, a positive hole transporting layer made of a positive hole transporting material, a light-emitting layer made of a light-emitting material, an electron transporting layer made of an electron transporting material and an electron injection layer made of an electron injection material, which can be clearly distinguished from each other. Instead, the EL layer forming the EL element is made of a layer (mixed layer: mixed region) of a mixture of a plurality of materials such as the positive hole injection material, positive hole transporting material, light-emitting material, electron transporting material and electron injection material hereinafter referred to as EL element of the mixed junction type. Here, the positive hole injection material, positive hole transporting material, light-emitting material, electron transporting material and electron injection material, are called functional materials having separate functions.

For instance, the EL layer of the EL element is constituted by a first region to where a first functional material is added, a second region to where is added a second functional material having a function separate from that of the first functional material, and a mixed region to which are added both the first functional material and the second functional material.

The above constitution may not have the region (first region) to where the first functional material only is added, but may be such that the ratio of concentration varies (has a gradient of concentration) in the region of the mixture of the first functional material and the second functional material. Or, the above constitution may not have neither the region (first region) to where the first functional material only is added nor the region (second region) to where the second functional material only is added, but may be such that the ratio of concentration varies (has a gradient of concentration) in the region of the mixture of the first functional material and the second functional material. The ratio of concentration may further vary depending upon the distance from the anode or the cathode. Further, the ratio of concentration may vary continuously. The manner of gradient of concentration may be freely set.

In the EL element having an explicit stacked layer structure, a problem arouses concerning the accumulation of electric charge on the interfaces of the layers constituted by the materials having different functions. The accumulation of electric charge on the interfaces of the layers becomes a serious cause of shortening the life of the EL element. In the EL element of the mixed junction type, on the other hand, there exists no explicit interface of layers, and the electric charge accumulates less. Thus, the mixed junction type EL element features an extended life. The drive voltage can be lowered, too.

Further, a metal material may be added to the EL layer of a portion that comes in contact with the electrode of the EL element. The EL element of this constitution, too, is called EL element of the mixed junction type. The above constitution enhances the efficiency for injecting carriers through the electrode while preventing the electrodes of the EL element from oxidizing. Thus, the EL element of the mixed junction type features an extended life. The drive voltage can be lowered, too.

Here, the EL layer of the EL element is not limited to those made of organic materials. The EL layer may be made of inorganic materials. Or, the EL layer may be made of both organic materials and inorganic materials.

Owing to the above constitution of the invention, there is provided a display device capable of emitting light maintaining a nearly constant brightness while decreasing a change in the brightness caused by a change in the current characteristics due to deterioration of the EL element.

In the foregoing was described the second method. Next, the third method will be described. The third method suppresses the EL element from deteriorating. According to this method, a reverse bias voltage is applied to the EL element at regular intervals. Thus, the EL element is suppressed from deteriorating.

In the foregoing were described the first method to third method. These methods are effective in suppressing the EL element from deteriorating. Next, described below is the use of these methods in combination with the current-controlled type pixels.

First, described below is a case of using the first method (first constitution or the second constitution) in combination with the current-controlled type pixels.

For example, the first constitution can be used in combination with the pixels of the current-controlled type. Described below is the constitution thereof.

A display device comprising:

a plurality of pixels and a plurality of signal lines to which are input current signals;

each of the plurality of pixels having a multi-drain element, a first TFT, a capacitor element, an EL element that emits light maintaining a brightness corresponding to the current signal, and a second TFT connected in series with the EL element;

the multi-drain element having an active layer formed by a semiconductor thin film on an insulating surface, an insulating film in contact with the active layer, and a gate electrode overlapped on the active layer via the insulating film;

the active layer having at least one channel-forming region and impurity regions of a number of n (n is a natural number of not smaller than 3);

the impurity regions of a number of m (m is a natural number of not smaller than 3 but is not larger than n) among the impurity regions of the number of n being in contact with different connection electrodes;

the impurity regions of the number of n being in contact with the channel-forming region; and any two impurity regions, among the impurity regions of the number of m, being connected together in the active layer through the channel-forming region only; wherein, the gate electrode of the second TFT is connected to the gate electrode of the first TFT;

one electrode of the capacitor element is connected to the gate electrode of the first TFT; and the first terminal of the first TFT, the gate electrode of the first TFT, and one of the plurality of signal lines are connected to the different connection electrodes.

A display device comprising:

a plurality of pixels and a plurality of signal lines to which are input current signals;

each of the plurality of pixels having a multi-drain element, a first TFT, a capacitor element, an EL element that emits light maintaining a brightness corresponding to the current signal, and a second TFT connected in series with the EL element;

the multi-drain element having an active layer formed by a semiconductor thin film on an insulating surface, an insulating film in contact with the active layer, and a gate electrode overlapped on the active layer via the insulating film;

the active layer having at least one channel-forming region and impurity regions of a number of n (n is a natural number of not smaller than 3);

the impurity regions of a number of m (m is a natural number of not smaller than 3 but is not larger than n) among the impurity regions of the number of n being in contact with different connection electrodes;

the impurity regions of the number of n having a low-concentration impurity region of an impurity concentration lower than that of the impurity regions formed between themselves and the channel-forming region; and any two impurity regions, among the impurity regions of the number of m, being connected together in the active layer through the channel-forming region and the low-concentration impurity region only; wherein, the gate electrode of the second TFT is connected to the gate electrode of the first TFT;

one electrode of the capacitor element is connected to the gate electrode of the first TFT; and the first terminal of the first TFT, the gate electrode of the first TFT, and one of the plurality of signal lines are connected to the different connection electrodes.

Here, the display device may be such that the first terminal of the second TFT is connected to one electrode of the EL element, and the second terminal of the first TFT and the second terminal of the second TFT are connected to the same wiring.

It is thus allowed to increase the numerical aperture in the pixels of the current-controlled type and to suppress the EL elements from deteriorating.

When the first constitution is combined with the pixel of the current controlled type, it is, further, allowed to use the second constitution in combination. Described below is the constitution thereof.

The plurality of pixels include first pixels emitting light of a first color and second pixels emitting light of a color different from the first color, and ends of the EL layers of the EL elements of the first pixels are formed being overlapped on the ends of the EL layers of the EL elements of the second pixels.

It is thus allowed to further increase the numerical aperture of the pixels of the current-controlled type and to further suppress the EL elements from deteriorating.

When the pixels of the current-controlled type are combined with one or both of the first constitution and the second constitution, there can be further combined the second method. Described below is the constitution thereof.

The EL element has the first electrode, the second electrode and the EL layer held between the first electrode and the second electrode, and the EL layer has a mixed region to where are added both a first functional material and a second functional material having a function separate from that of the first functional material.

This makes it possible to further suppress the EL elements from deteriorating.

When the pixels of the current-controlled type are combined with any one or a plurality of the first constitution, the second constitution and the second method, then, there can be further combined the third method. Namely, the above constitution includes means for decreasing the potential at the anode of the EL element to be lower than the potential at the cathode of the EL element.

This further suppresses the EL elements from deteriorating.

Next, described below is the constitution in which the pixels of the current-controlled type are combined with the second constitution.

A display device comprising:

a plurality of pixels;

each of the plurality of pixels including:

an EL element having a first electrode, a second electrode, and an EL layer held between the first electrode and the second electrode, and means for setting constant an electric current that flows across the first electrode and the second electrode of the EL element;

the plurality of pixels including first pixels emitting light of a first color and second pixels emitting light of a color different from the first color; and the ends of the EL layers of EL elements in the first pixels being overlapped on the ends of the EL layers of EL elements in the second pixels.

A display device comprising:

a plurality of pixels and a plurality of signal lines to which are input current signals;

each of the plurality of pixels including:

an EL element having a first electrode, a second electrode, and an EL layer held between the first electrode and the second electrode, means for converting a first current input to the plurality of pixels from the plurality of signal lines, into a voltage;

means for holding the voltage; and means for converting the voltage into a second current which flows between the first electrode and the second electrode of the EL element;

the plurality of pixels including first pixels emitting light of a first color and second pixels emitting light of a color different from the first color; and the ends of the EL layers of EL elements in the first pixels being overlapped on the ends of the EL layers of EL elements in the second pixels.

It is thus allowed to increase the numerical aperture in the pixels of the current-controlled type and to suppress the EL elements from deteriorating.

When the pixels of the current-controlled type are combined with the second constitution, then, there can be further combined the second method. Described below is the constitution thereof.

The EL element has the first electrode, the second electrode and the EL layer held between the first electrode and the second electrode, and the EL layer has a mixed region to where are added both a first functional material and a second functional material having a function separate from that of the first functional material.

This further suppresses the EL elements from deteriorating.

When the pixels of the current-controlled type are combined with either one or both of the second constitution in the first method and the second method, it is allowed to further combine the third method. That is, the above constitution has means for decreasing the potential at the anode of the EL element to be lower than the potential at the cathode of the EL element.

This further suppresses the EL elements from deteriorating.

Further, the pixel of the current-controlled type can be combined with the second method. Described below is the constitution thereof.

A display device comprising:

a plurality of pixels;

each of the plurality of pixels including:

an EL element having a first electrode, a second electrode, and an EL layer held between the first electrode and the second electrode; and means for setting constant a current that flows between the first electrode and the second electrode of the EL element;

the EL layer having a mixed region to where are added both a first functional material and a second functional material having a function separate from that of the first functional material.

A display device comprising:

a plurality of pixels and a plurality of signal lines to which are input current signals;

each of the plurality of pixels including:

an EL element having a first electrode, a second electrode, and an EL layer held between the first electrode and the second electrode, means for converting a first current input to the plurality of pixels from the plurality of signal lines, into a voltage;

means for holding the voltage; and means for converting the voltage into a second current which flows between the first electrode and the second electrode of the EL element;

the EL layer having a mixed region to where are added both a first functional material and a second functional material having a function separate from that of the first functional material.

By using the EL elements which are suppressed from deteriorating, it is allowed to obtain a display device suppressing the dispersion in the brightness thereof.

When the pixels of the current-controlled type are combined with the second method, it is allowed to further combine the third method. Namely, the above constitution possesses means for decreasing the potential at the anode of the EL element to be lower than the potential at the cathode of the EL element.

This further suppresses the EL elements from deteriorating.

The pixel of the current-controlled type can be further combined with the third method.

A display device comprising:

a plurality of pixels;

each of the plurality of pixels including:

an EL element having a first electrode, a second electrode, and an EL layer held between the first electrode and the second electrode; and means for setting constant a current that flows between the first electrode and the second electrode of the EL element;

one of the first electrode or the second electrode of the EL element being an anode, and the other one being a cathode; and, further, comprising:

means for decreasing the potential at the anode of the EL element to be lower than the potential at the cathode of the EL element.

A display device comprising:

a plurality of pixels and a plurality of signal lines to which are input current signals;

each of the plurality of pixels including:

an EL element having a first electrode, a second electrode, and an EL layer held between the first electrode and the second electrode, means for converting a first current input to the plurality of pixels from the plurality of signal lines, into a voltage;

means for holding the voltage; and means for converting the voltage into a second current which flows between the first electrode and the second electrode of the EL element;

one of the first electrode or the second electrode of the EL element being an anode, and the other one being a cathode; and, further, comprising:

means for decreasing the potential at the anode of the EL element to be lower than the potential at the cathode of the EL element.

This further suppresses the EL elements from deteriorating.

The EL layer of the EL element may be made of a high-molecular material (polymer), a low-molecular material or an intermediate-molecular material. Or, these materials may be used in combination. The intermediate-molecular material is the one that does not sublime and has a degree of polymerization of not larger than about 20. The EL element may be either the one which utilizes the emission of light (fluorescence) from the singlet excitons or the one which utilizes the emission of light (phosphorescence) from the triplet excitons.

The above constitution makes it possible to provide a display device capable of emitting light maintaining nearly a constant brightness while decreasing a change in the brightness caused by a change in the current characteristics stemming from the deterioration in the EL elements.

BRIEF DESCRIPTION OF THE DRAWINGS

FIGS. 11A–C are diagrams illustrating how to drive the pixel of the current-controlled type;

DESCRIPTION OF THE PREFERRED EMBODIMENTS

Embodiment 1

Figure 1A:
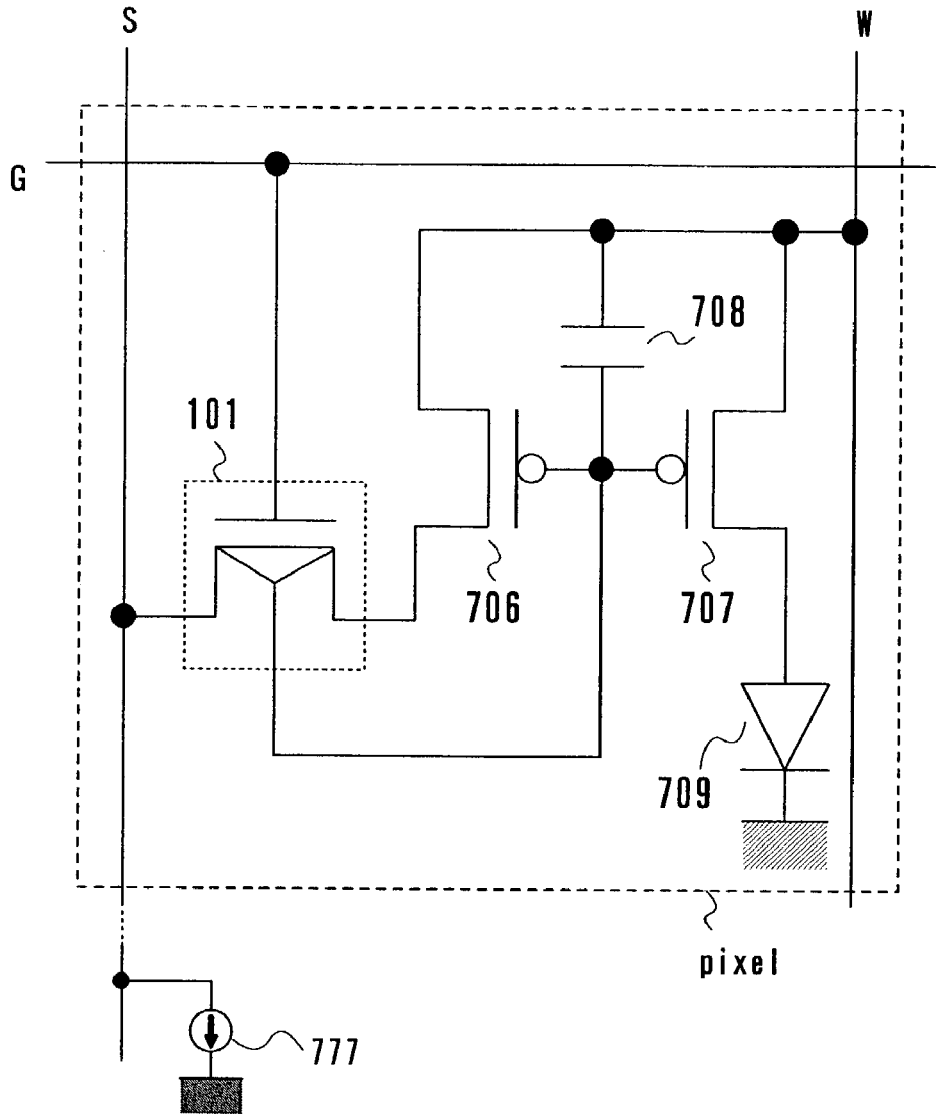
FIG. 1A and FIG. 1B are diagrams illustrating the constitutions of pixels in a display device of this invention.
Figure 10:
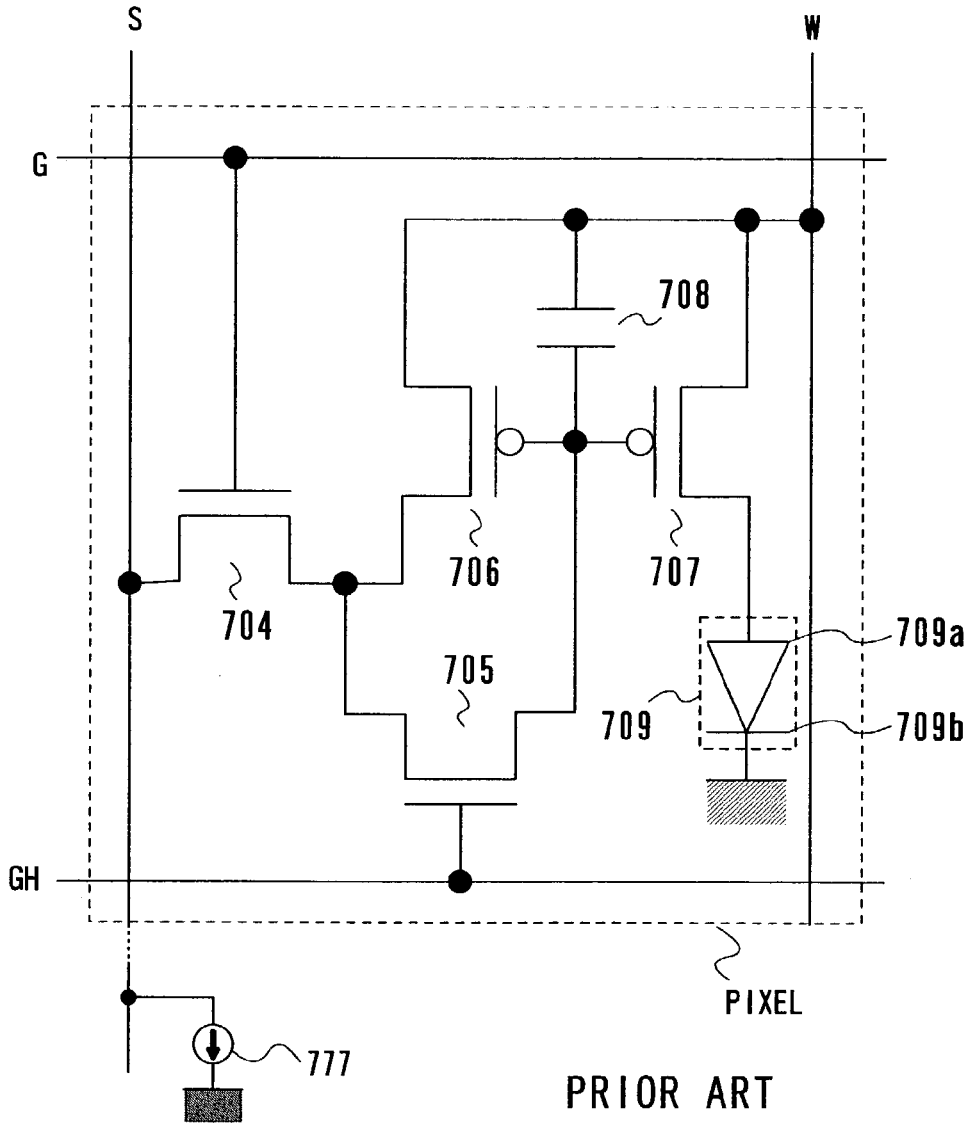
FIG. 10 is a diagram illustrating the constitution of a current-controlled type pixel.

The embodiment 1 deals with the constitution of a multi-drain element and the constitution of a pixel in the display device of the invention using the multi-drain element. FIG. 1A illustrates the constitution of the pixel using the multi-drain element of the invention. In FIG. 1A, the portions same as those of the conventional pixel constitution shown in FIG. 10 are denoted by the same reference numerals but their description is not repeated. FIG. 1A illustrates a case where a drive TFT 707 and a current TFT 706 are the p-channel TFTs, and the pixel electrode is an anode.

FIG. 1A employs a multi-drain element 101 instead of the select TFT 704 and holding TFT 705 used in FIG. 10. Terminals of the multi-drain element 101 in FIG. 1A will be described with reference to FIG. 1B. The multi-drain element 101 has a terminal T0 and terminals T1 to T3.

Figure 1B:
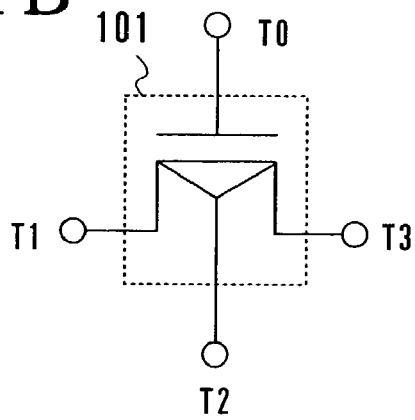

Depending upon a signal potential input to the terminal T0, the multi-drain element 101 selects a state where the terminals T1 up to T3 (between the terminal T1 and the terminal T2, between the terminal T2 and the terminal T3, between the terminal T1 and the terminal T3) are opened or a state where they are closed. FIG. 1B illustrates, by using a symbol, the multi-drain element capable of selecting the state where the terminal T1 up to the terminal T3 are opened and the state where they are closed depending upon the signal potential input to the terminal T0.

Reverting to FIG. 1A, the terminal T0 of the multi-drain element 101 is connected to a gate signal line G. The gate electrode of the current TFT 706 is connected to the first terminal of the current TFT 706 through the terminals T2 and T3 of the multi-drain element 101. Further, the first terminal of the current TFT 706 is connected to a signal line S through the terminals T3 and T1 of the multi-drain element 101.

In FIG. 1A, the second terminal of the current TFT 706 and the second terminal of the drive TFT 707 are connected to a power line W. However, the pixel constitution of this invention is in no way limited thereto only. In general, the second terminal of the current TFT 706 and the second terminal of the drive TFT 707 may be so constituted as to assume the same potential when a drain current flows thereto.

Between the two electrodes of the holding capacity 708, further, the one on the side that is not connected to the gate electrode of the drive TFT 707 is connected to the power line W. The pixel constitution of the invention, however, is in no way limited thereto only. Between the two electrodes of the holding capacity 708, in general, the one that is not connected to the gate electrode of the drive TFT 707 may be so constituted as to maintain a potential equal to the potential at the second terminals of the respective TFTs while a current is flowing into the current TFT 706 or to the drive TFT 707.

When the pixel electrode of the EL element is a cathode unlike that of FIGS. 1A–B and when the EL element emits light, it is desired that the pixel operates with the potential at the source terminals of the current TFT 706 and of the drive TFT 707 being fixed. It is therefore desired to use the N-channel TFTs as the current TFT 706 and drive TFT 707.

Here, FIGS. 2A–D illustrates an example of fabricating the multi-drain element 101 of FIGS. 1A–B.

Figure 2A:
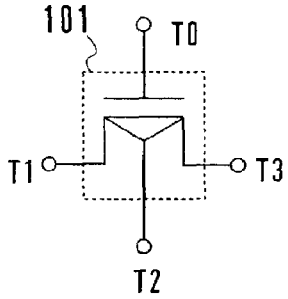
FIGS. 2A–D are diagrams illustrating the constitutions of a multi-drain element possessed by the pixel in the display device of the invention.
Figure 2B:
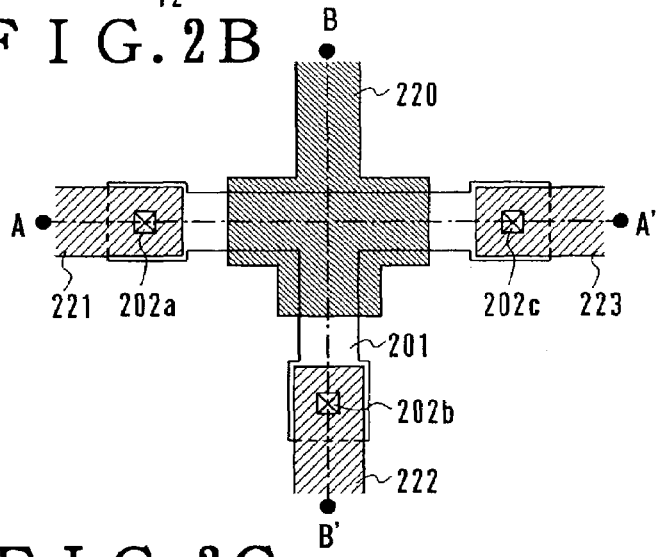
Figure 2C:
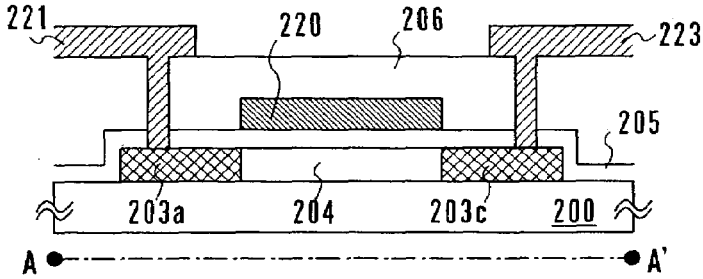
Figure 2D:
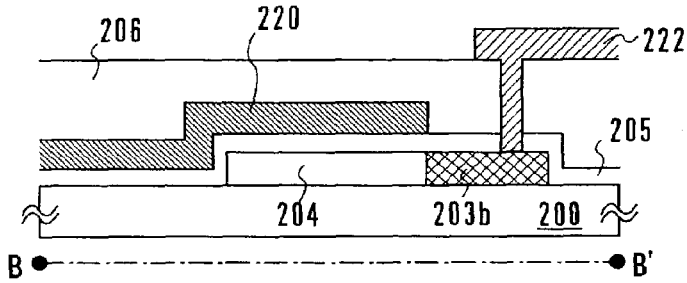

First, FIG. 2A shows a symbol of the multi-drain element. FIG. 2B is a top view of when the multi-drain element shown in FIG. 2A is fabricated. FIG. 2C is a sectional view along the line A–A' in FIG. 2B. FIG. 2D is a sectional view along the line B–B' in FIG. 2B. In FIG. 2B, the multi-drain element 101 has an active layer 201, an electrode 220 and connection electrodes 221 to 223. In FIGS. 2C and 2D, the active layer 201 formed on a substrate 200 having an insulating surface includes impurity regions 203*a* to 203*c* to where are added impurities that impart the same type of electric conduction, and a channel region 204. The electrode 220 is overlapped on the channel-forming region 204 via a gate-insulating film 205. The connection electrodes 221 to 223 are formed on an insulating film 206 formed on the electrode 220, and are electrically connected to the impurity regions 203*a* to 203*c* through contact holes 202*a* to 202*c*. The electrode 220 corresponds to the terminal T0 in FIG. 2A. Further, the connection electrode 221 corresponds to the terminal T1, the connection electrode 222 corresponds to the terminal T2, and the connection electrode 223 corresponds to the terminal T3.

Further, the connection electrode 221 may correspond to the terminal T2, the connection electrode 222 may correspond to the terminal T3, and the connection electrode 223 may correspond to the terminal T1. Or, the connection electrode 221 may correspond to the terminal T3, the connection electrode 222 may correspond to the terminal T1, and the connection electrode 223 may correspond to the terminal T2.

The impurity regions 203*a* to 203*c* are in contact with the channel-forming region 204. In this embodiment, the impurity regions are all in contact with the channel-forming region 204, to which only, however, the invention is in no way limited. A low-concentration impurity region (LDD region) having an impurity concentration lower than that of the impurity regions 203*a* to 203*c* may be provided between the impurity regions 203*a* to 203*c* and the channel-forming region 204.

In FIGS. 2C and 2D, the gate-insulating film 205 is covering the impurity regions 203*a* to 203*c*, to which only, however, the invention is in no way limited. The impurity regions 203*a* to 203*c* need not necessarily be covered with the gate-insulating film 205 but may be exposed.

The multi-drain element 101 can be fabricated through a process same as the one for fabricating the normal TFTs. In FIGS. 2C and 2D, the electrode 220 of the multi-drain element 101 of the invention can be made of a material which is the same as that of the gate electrode of the known TFTs. Further, the channel-forming region 204 and the impurity regions 203*a* to 203*c* can be formed in the active layer 201 in the same manner as that of the conventional TFTs.

Here, a portion of the electrode 220 that overlaps the active layer 201 is also called gate electrode of the multi-drain element. The impurity regions 203*a* to 203*c* to where the terminals T1 to T3 of the multi-drain terminal are connected are called source regions or drain regions. Further, the terminals T1 to T3 of the multi-drain element are also called source terminals or drain terminals.

Depending upon a potential applied to the electrode (gate electrode) 220, the multi-drain element 101 shown in FIGS. 2A–D changes its channel formed in the channel-forming region 204 and is controlled for its resistance among the terminals T1 to T3 (corresponds to between the source terminal and the drain terminal). Namely, due to the potential at the gate electrode 220, a channel is formed in the channel-forming region, and a passage between the source terminal and the drain terminal is rendered conductive.

In FIGS. 2A–D, for example, an impurity element for imparting the N-type is added to the impurity regions 203*a* to 203*c* in the multi-drain element 101. In this case, the potential at the gate electrode T0 is set to be sufficiently higher than the potential in the source region that corresponds to any one or two of the impurity regions 203*a* to 203*c*. Thus, the terminal T1 to the terminal T3 can be short-circuited. The thus constituted multi-drain element 101 is called N-channel multi-drain element.

In FIGS. 2A–D, on the other hand, an impurity element for imparting the P-type is added to the impurity regions 203*a* to 203*c* in the multi-drain element 101. In this case, the potential at the gate electrode T0 is set to be sufficiently lower than the potential in the source region that corresponds to any one or two of the impurity regions 203*a* to 203*c*. Thus, the terminal T1 to the terminal T3 can be short-circuited. The thus constituted multi-drain element is called P-channel multi-drain element.

The switching element (multi-drain element) is not limited to the constitution in which the active layer, insulating film and gate electrode are formed in this order on the insulating surface formed on the substrate. The constitution may be such that the gate electrode, insulating film and active layer are formed in this order on the insulating surface formed on the substrate. Further, the gate electrode of the multi-drain element may be formed on both the upper and lower sides of the active layer through an insulating film, respectively.

Thus, the multi-drain element 101 of FIGS. 2A–D is capable of simultaneously connecting three nodes or, concretely speaking, simultaneously connecting the terminals T1 up to T3.

By using the thus constituted multi-drain element 101, it is allowed to suppress the area occupied by the switching element in the pixel and, hence, to increase the numerical aperture of the pixel.

Figure 12:
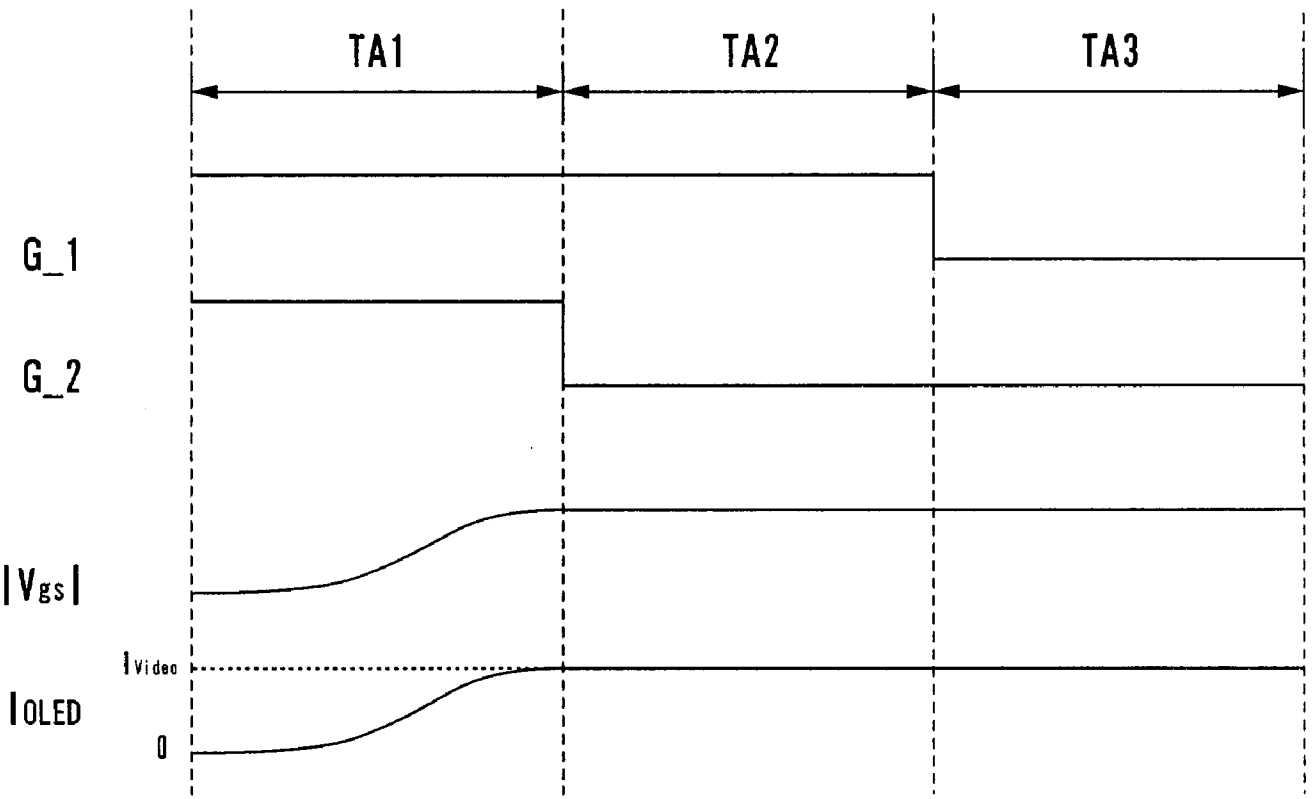
FIG. 12 is a timing chart illustrating how to drive the display device of the invention.

The pixel constituted as shown in FIGS. 1A–B is driven by a method the same as the conventional method illustrated by using a timing chart of FIG. 12. Here, however, the first gate signal line G and the second gate signal line GH in the pixel constitution shown in FIG. 10 are shared as a gate signal line G in the pixel constitution of this invention shown in FIGS. 1A–B. Thus, during a period TA1, the terminals T1 to T3 of the multi-drain element 101 are short-circuited due to a signal of the gate signal line G. After the end of a period TA2, however, the terminals T1 to T3 of the multi-drain element are opened due to a signal of the gate signal line G. Thus, the EL element 709 emits light in each pixel to display the image.

In the constitution shown in FIGS. 1A–B, a current flows from the anode 709*a* to the cathode 709*b* of the EL element 709 due to the above method and when the EL element 709 emits light, the second terminal of the current TFT 706 corresponds to the source terminal, and the first terminal thereof corresponds to the drain terminal. Further, the second terminal of the drive TFT 707 corresponds to the source terminal, and the first terminal corresponds to the drain terminal.

A pair of current TFT 706 and drive TFT 707 constitute a current mirror circuit. Therefore, these two TFTs must have the same polarity. It is further desired that these two TFTs have equal characteristics in the same pixel. The TFTs having equal characteristics stand for that the TFTs have the same threshold voltage, the same mobility, etc.

Here, it is also possible to change a ratio of the current input to the source signal line and the current flowing into the EL element by changing the ratio of the gate length and the gate width of the drive TFT 707 relative to a ratio of the gate length and the gate width of the current TFT 706.

In FIGS. 1A–B, the multi-drain element 101 is of a constitution of the N-channel type. Here, however, the multi-drain element of FIG. 1 may be either of the N-channel type or the P-channel type. However, when the pixel electrode of the EL element 709 is the anode as in the pixel constitution shown in FIGS. 1A–B, it is desired that the source terminal of the multi-drain element 101 is determined to be of the one type while the EL element emits light. It is therefore desired to use the multi-drain element 101 of the N-channel type.

As the gray scale display method, there can be employed an analog gray scale system which expresses the gray scale by receiving a signal current having an analog current value. It is also allowable to use a digital gray scale system which expresses the gray scale by receiving a signal current having a digital current value. The digital gray scale system may be either a time gray scale system which expresses the gray scale by controlling the period in which the EL element in the pixel emits light or an area gray scale system which expresses the gray scale by controlling the area of a portion that emits light in the pixel.

As the time gray scale system, there can be used, for example, a time division gray scale system. The time division gray scale system is the one in which one frame period is divided into a plurality of sub-frames, and a digital signal current is input to the pixels in each of the sub-frame periods, so that the EL elements in the pixels may or may not emit light maintaining nearly a constant brightness, thereby to express the gray scale depending upon the accumulated length of the sub-frame periods in which the EL elements have emitted light in one frame period. The one frame period stands for a period for displaying one image.

Figure 3:
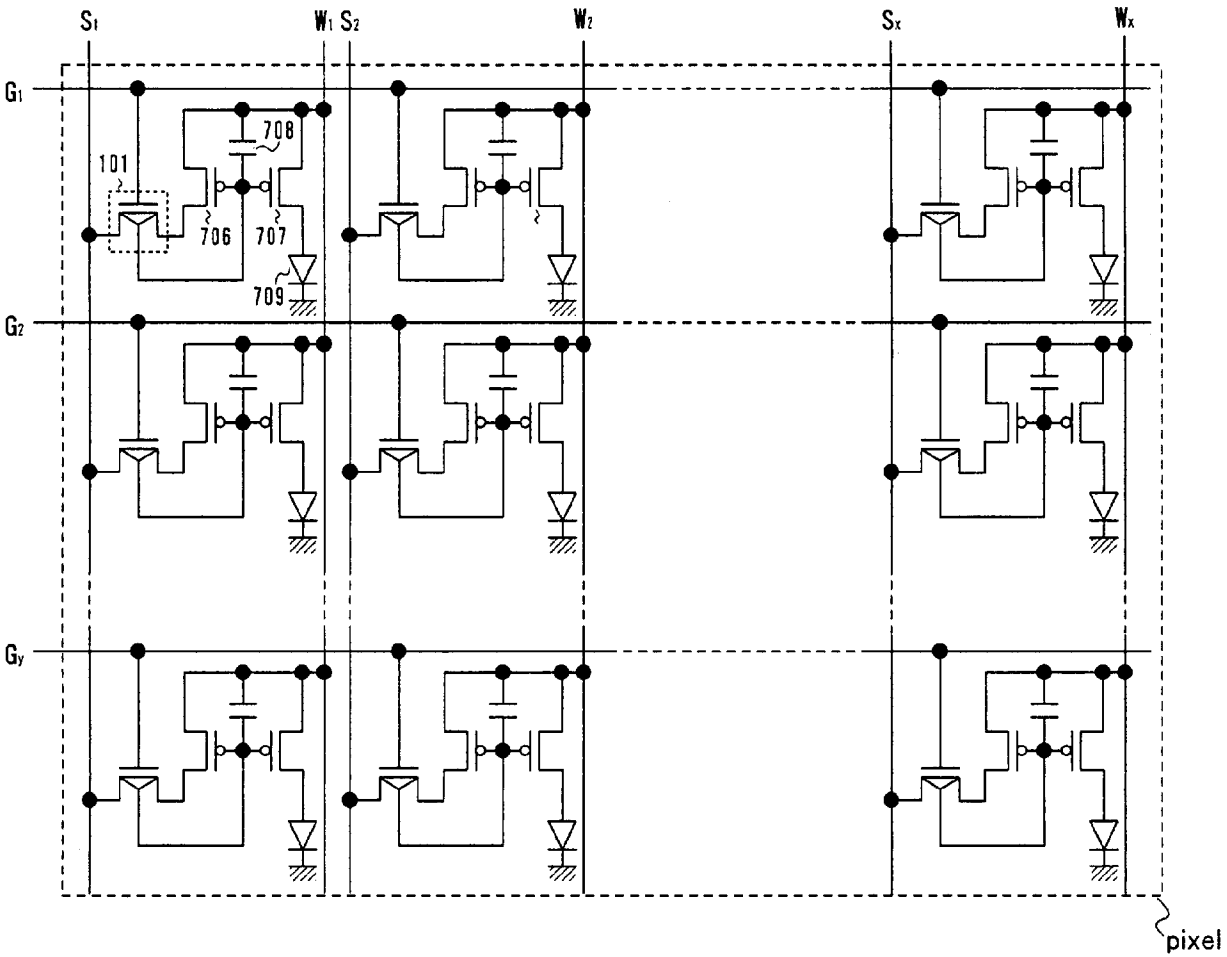
FIG. 3 is a diagram illustrating the constitutions of a pixel unit in the display device of the invention.

Described below is a case when the display device of the invention is driven by the time division gray scale system. For explanation, FIG. 3 shows a circuit diagram of a pixel unit having pixels of the constitution shown in FIGS. 1A–B. The same portions as those of FIGS. 1A–B are denoted by the same reference numerals. In FIG. 3, the pixel unit includes pixels of x columns and y rows. In general, a source signal line S of a pixel of an i-th (i is a natural number of not larger than x) column and of a j-th (j is a natural number of not larger than y) row, is denoted by $S_i$, a gate signal line G thereof is denoted by $G_j$, and a power line W thereof is denoted by $W_i$. Here, in the pixel unit, the power line W may be shared by the pixels of different columns.

Figure 4A:
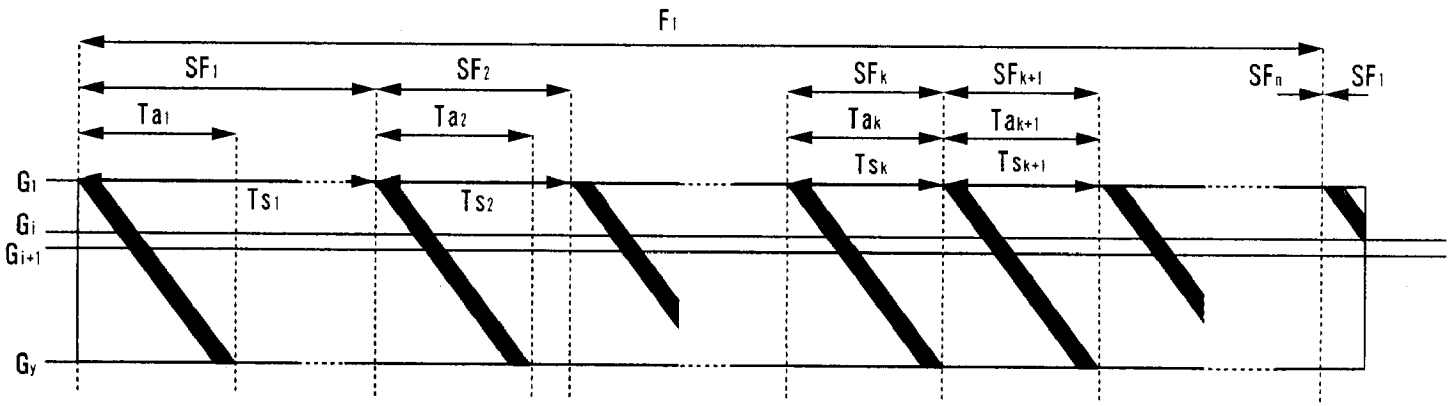
FIG. 4A and FIG. 4B are timing charts illustrating how to drive the display device of the invention.
Figure 4B:
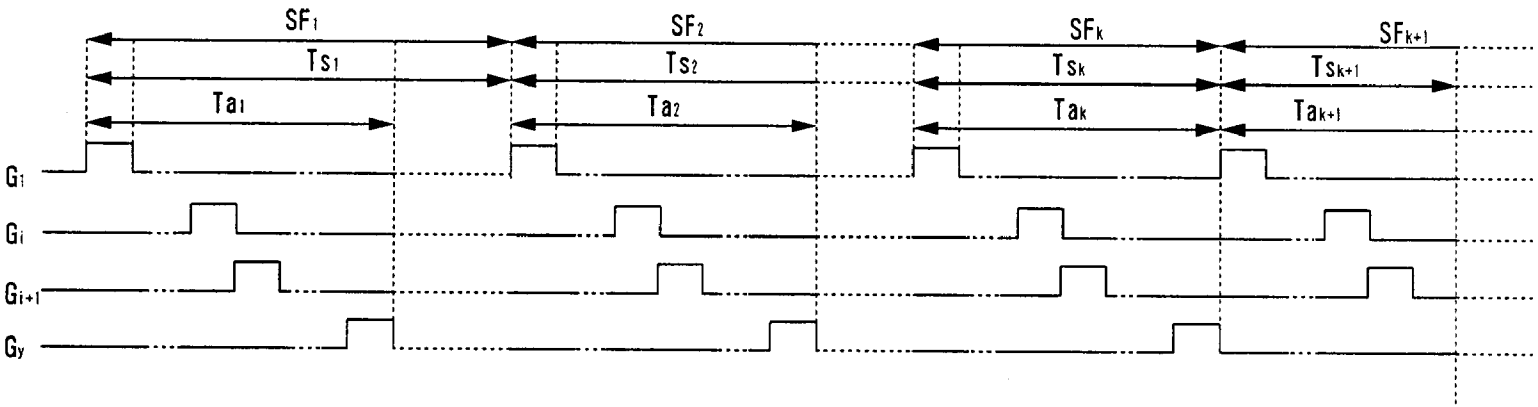

The pixel unit of the constitution shown in FIG. 3 will now be described with reference to a timing chart shown in FIGS. 4A–B when it is driven by the time division method. In FIGS. 4A and 4B, the same portions are denoted by the same symbols. Here, in FIG. 4B, $G_1$ to $G_y$ denote potentials of signals input to the gate signal lines $G_1$ to $G_y$.

A one frame period $F_1$ is divided into a plurality of sub-frame periods $SF_1$ to $SF_n$ (n is a natural number). In a first sub-frame period $SF_1$, a gate signal line $G_1$ of a first row is selected, first. Here, selecting a gate signal line stands for that a signal potential is input to the gate signal line to short-circuit the terminals T1 up to T3 of the multi-drain element 101 which is connected at its gate electrode to the gate signal line. Thus, the multi-drain element 101 connected at its terminal T0 to the gate signal line $G_1$ is placed in a state where the terminals T1 up to T3 thereof are short-circuited.

Then, a digital signal current is input to the source signal lines $S_1$ to $S_x$. In the pixels corresponding to the source signal lines to which the signal current is input, the signal current flows between the first terminal and the second terminal (corresponds to between the source and the drain) of the current TFT 706 through the multi-drain element 101. Here, the first terminal and the gate electrode of the current TFT 706 are electrically connected together through the multi-drain element 101. After the passage of a sufficient period of time, the drive TFT 707 permits a predetermined current to flow into the EL element 709. The operation of the EL element of the pixel for emitting light in response to the input signal current is the same as that of the Embodiment 1, and is not described here again. Thus, depending upon whether the signal current is input to the source signal lines $S_1$ to $S_x$, there is selected a state where the pixels of the first row emit light or do not emit light. In the pixels of the first row, when an electric charge with which the drive TFT 707 flows a constant current is held by the holding capacitor 708 in the pixel that has been selected to emit light, then, the signal of the gate signal line $G_1$ changes to assume the non-selected state. Thus, the terminals T1 up to T3 of the multi-drain element 101 are opened.

In the pixels for which the light-emitting state has been selected, the operation for holding an electric charge in the holding capacitor 708 so that the drive TFT 707 flows a constant current, is called writing operation of the pixels.

As soon as the gate signal line $G_1$ is placed in the non-selected state, the gate signal line $G_2$ of the second row is selected, whereby the multi-drain element 101 connected at its gate electrode (terminal T0) to the gate signal line $G_2$ is short-circuited at its terminals T1 to T3. Thereafter, a digital signal current is input to the source signal lines $S_1$ to $S_x$. The operation hereinbelow is the same as that of the pixels of the first row.

The same operation is conducted for all of the gate signal lines $G_1$ to $G_y$. The period for selecting all of the gate signal lines $G_1$ to $G_y$ is expressed as address period Ta. The address period corresponding to the m-th (m is a natural number of not larger than n) sub-frame period $SF_m$ is expressed as $Ta_m$.

The row of pixels that has finished the writing operation, is placed in the state of emitting light or not emitting light. Further, the period in which the row of pixels emit light or not emit light depending upon the written signal, is expressed as display period Ts. In the same sub-frame period, the display periods Ts of the rows of pixels all have the same length though their timings differ. The display period corresponding to the m-th (m is a natural number of not larger than n) sub-frame period $SF_m$ is expressed as $Ts_m$.

Here, since the writing operation cannot be simultaneously executed for different rows of pixels, the display period Ts is set to be longer than the address period Ta. A second sub-frame period $SF_2$ starts after the display period $Ts_1$ of a predetermined length. The operation same as the first sub-frame period $SF_1$ is conducted even for the second sub-frame period $SF_2$ through up to the n-th sub-frame period $SF_n$ to finish the one frame period F. Here, the address periods $Ta_1$ to $Ta_n$ in the sub-frame periods $SF_1$ to $SF_n$ all have the same length.

The display device is operated as described above, and the lengths of the display periods $Ts_1$ to $Ts_n$ of the sub-frame periods $SF_1$ to $SF_n$ are suitably set to express the gray scale.

Here, the invention is not limited to the method of expressing the gray scale by providing the sub-frame periods in a number same as the number of bits of the video signal in one frame period. For example, there can be provided in one frame period a plurality of sub-frame periods for which the state of emitting light or not emitting light is selected depending upon a signal corresponding to a given bit of a video signal. Namely, the display period corresponding to one bit is expressed by the accumulated display period of the plurality of sub-frame periods. In particular, the display period corresponding to the upper bits of the video signal is expressed by the accumulated display period of the plurality of sub-frame periods, and these sub-frame periods are caused to appear in a discrete manner to suppress the occurrence of a pseudo-contour.

Figures 7A, 7B:
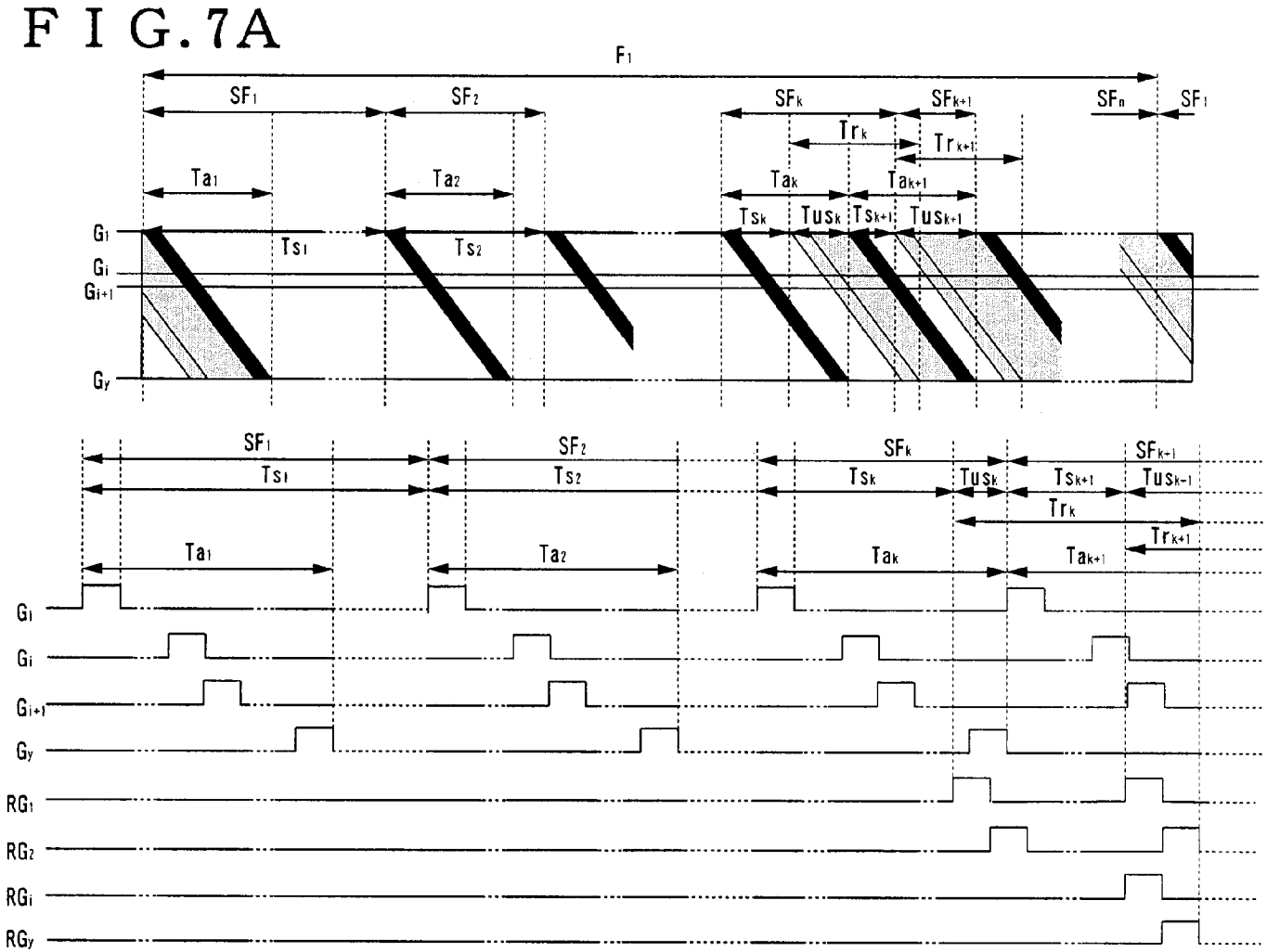
FIG. 7A and FIG. 7B are timing charts illustrating how to drive the display device of the invention.

How to set the length of the display period Ts of the sub-frame periods is not limited to the above method only but can be done by any known method. In FIGS. 7A–B, further, though the first sub-frame period $SF_1$ through the n-th sub-frame period $SF_n$ were set to appear successively, the invention is in no way limited thereto only. The order by which the sub-frame periods appear can be set arbitrarily.

Not only by the time division gray scale system, the gray scale can also be expressed even by the area gray scale system or by a combination of the time division gray system and the area gray scale system.

According to the embodiment 1 as described above, the image is displayed by the display device having pixels of the constitution shown in FIGS. 1A–B and 3.

Embodiment 2

Figure 5:
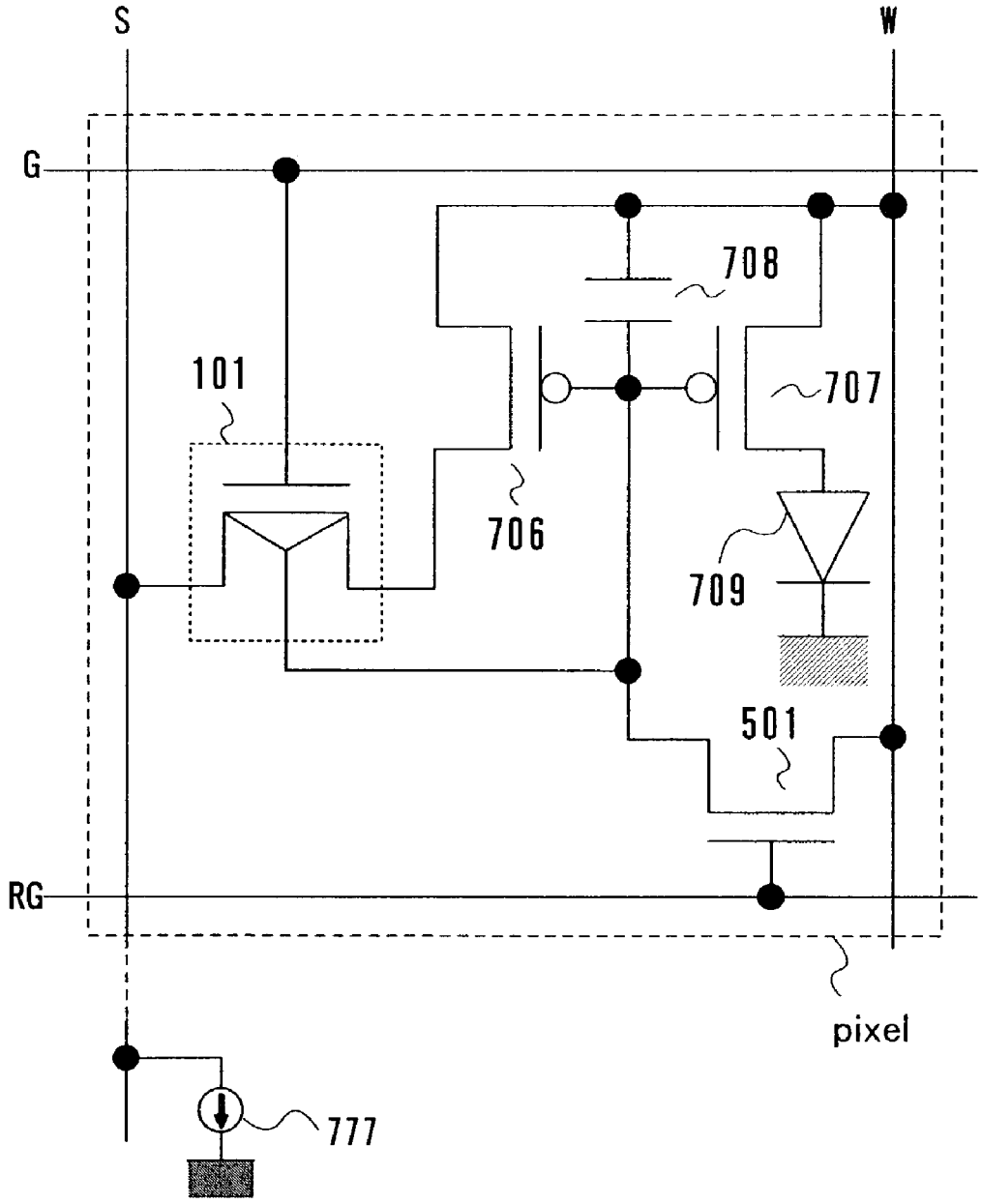
FIG. 5 is a diagram illustrating the constitution of the pixel in the display device of the invention.

The embodiment 2 deals with the pixel of a constitution different from that of the embodiment 1. FIG. 5 illustrates the constitution of the pixel of this embodiment. The portions same as those of FIGS. 1A–B are denoted by the same reference numerals but are not described here again. The pixel of the constitution shown in FIG. 5 is provided with an erasing TFT 501 in parallel with the holding capacitor 708. The erasing TFT 501 and the holding capacitor 708 need not necessarily be connected in parallel. When rendered conductive, the erasing TFT 501 may be so connected as to nearly equalize the potentials at both electrodes of the holding capacity 708. Owing to the above constitution, the electric charge held by the holding capacity 708 can be discharged by rendering the erasing TFT 501 conductive. Thus, the drive TFT 707 is rendered nonconductive. In the pixel in which the drive TFT 707 is rendered nonconductive, the EL element 709 does not emit light.

Here, the gate electrode of the erasing TFT 501 is connected to a line separate from the gate signal line G, i.e., to an erasing gate signal line RG. Due to a signal input to the erasing gate signal line RG, the conducting/nonconducting state of the erasing TFT 501 is changed over. Therefore, the pixels of a separate row can be placed in the state of not emitting light while a video signal (signal current) is being input to the pixels of a given row.

Figure 6:
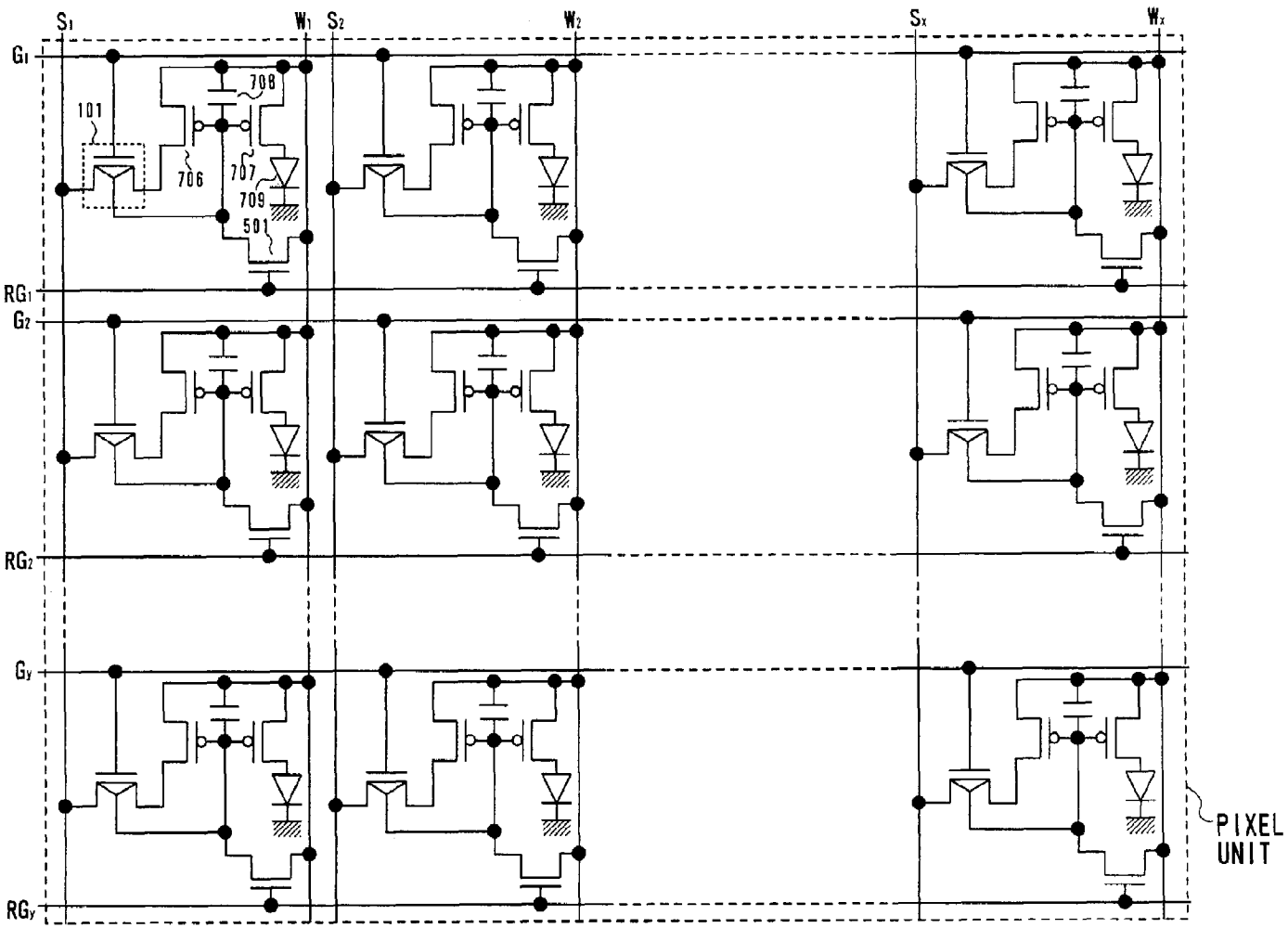
FIG. 6 is a diagram illustrating the constitution of the pixel unit in the display device of the invention.

FIG. 6 is a circuit diagram of a pixel unit having pixels constituted as shown in FIG. 5. The portions same as those of FIG. 5 are denoted by the same reference numerals but their description is not repeated. In FIG. 6, the pixel unit includes pixels of x columns and y rows. In general, a source signal line S of a pixel of an i-th (i is a natural number of not larger than x) column and of a j-th ( is a natural number of not larger than y) row, is denoted by $S_i$, a gate signal line G thereof is denoted by $G_j$, an erasing gate signal line RG is denoted by $RG_j$, and a power line W thereof is denoted by $W_i$.

The pixel unit of the constitution shown in FIG. 6 will now be described with reference to a timing chart shown in FIGS. 7A–B when it is driven by the time division method. In FIGS. 7A and 7B, the same portions are denoted by the same symbols. Here, in FIG. 7B, $G_1$ to $G_y$ denote potentials of signals input to the gate signal lines $G_1$ to $G_y$. Further, $RG_1$ to $RG_y$ in FIG. 7B denote potentials of signals input to the erasing gate signal lines $RG_1$ to $RG_y$.

In FIGS. 5 and 6, the multi-drain element 101 is of the N-channel type. Here, however, the multi-drain element may be either of the N-channel type or the P-channel type. When the pixel electrode of the EL element 709 is the anode like in the pixel constitution shown in FIGS. 5 and 6, however, it is desired that the source terminal of the multi-drain element 101 operates being determined to be of the one type while the EL element emits light. It is therefore desired to use the multi-drain element 101 of the N-channel type. In FIGS. 5 and 6, further, though the erasing TFT 501 is of the N-channel TFT, the device is in no way limited thereto only.

The erasing TFT 501 operates simply as a switch and may, hence, be either the N-channel TFT or the P-channel TFT.

Basic operations of the address period Ta and the display period Ts in the sub-frame periods $SF_1$ to $SF_n$ are the same as the operations of the embodiment 1 described with reference to the timing chart of FIGS. 4A–B.

Since the video signal (signal current) cannot be simultaneously written to the pixels of the plurality of rows, the address periods Ta in the sub-frame periods $SF_1$ to $SF_n$ are so set as will not to be overlapped one upon the other. In the embodiment 1, therefore, the display period Ts could not be set to be shorter than the address period Ta. However, if the pixels of the constitution shown in FIGS. 5 and 6 are used in the embodiment 2, the display period Ts can be set to be shorter than the address period Ta.

It is now presumed that the display period Ts is set to be longer than the address period Ta from the first sub-frame period $SF_1$ through up to the (k−1)-th (k is a natural number of not larger than n) sub-frame period $SF_{k-1}$. The driving method at this moment is the same as the operation of the embodiment 1 illustrated with reference to the timing chart of FIGS. 4A–B. Here, the erasing TFT 501 in each of the pixels is nonconductive at all times.

Described below in detail is a method of driving the display device from the k-th sub-frame period $SF_k$ up to the n-th sub-frame period $SF_n$ in which the display period Ts is set to be shorter than the address period Ta.

The operation method of the address period $Ta_k$ in the k-th sub-frame period $SF_k$ is the same as that of from the first sub-frame period $SF_1$ up to the (k−1)-th sub-frame period $SF_{k-1}$. Here, however, the erasing TFT 501 is nonconductive in the row of pixels which are executing the writing operation. After the display period $Ts_k$ of a predetermined length, the erasing gate signal lines $RG_1$ to $RG_y$ are successively selected, the erasing TFTs 501 are successively rendered conductive in each row of pixels, and the rows of pixels are successively put to the state of not emitting light. A period in which the erasing TFTs 501 of all pixels are rendered conductive, is denoted as a reset period Tr. In particular, a reset period corresponding to the p-th (p is a natural number of not smaller than k but is not larger than n) sub-frame period $SF_p$ is denoted by $Tr_p$. Thus, the pixels of another row can be put to the state of not emitting light at one time while the signal current is being input to the pixels of a given row. Thus, the length of the display period Ts can be freely controlled.

Here, the length of the address period $Ta_p$ is set to be the same as the length of the reset period $Tr_p$. Namely, the rate of successively selecting the rows at the time of writing the video signals is the same as the rate of successively putting the rows of pixels to the state of not emitting light. In the same sub-frame period, therefore, the display periods Ts of the rows of pixels all have the same length though their start timing differs.

The period for putting the row of pixels to the state of not emitting light at one time by rendering the erasing TFTs 501 in the rows of pixels, is denoted by a non-display period Tus. In the same sub-frame period, the non-display periods Tus of the rows of pixels have different timings but all have the same length. In particular, the non-display period corresponding to the p-th sub-frame period $SF_p$ is denote by $Tus_p$.

After the non-display period $Tus_k$ of a predetermined length, the (k+1)-th sub-frame period $SF_{k+1}$ starts. The operation same as that of the k-th sub-frame period $SF_k$ is repeated for the (k+1)-th sub-frame period $SF_{k+1}$ up to the n-th sub-frame period $SF_n$ to finish one frame period F1.

The display device is operated as described above, and the lengths of display periods $Ts_1$ to $Ts_n$ are suitably determined in the sub-frame periods $SF_1$ to $SF_n$ to express the gray scale. The lengths of display periods Ts in the sub-frame periods are set in the same manner as in the embodiment 1.

The embodiment 2 has dealt with the driving method of setting the reset period Tr and the non-display period Tus in the sub-frame periods only in which the display period Ts was set to be shorter than the address period Ta. The invention, however, is in no way limited thereto only. The driving method may be such that the reset period Tr and the non-display period Tus are set even in the sub-frame periods in which the display period Ts is set to be longer than the address period Ta.

FIGS. 5 and 6 have illustrated the constitution in which the electric charge of the holding capacity 708 was discharged upon rendering the erasing TFT 501 to be conductive. The invention, however, is in no way limited thereto, either. The constitution may be such that the erasing TFT 501 is rendered conductive to increase or decrease the potential of the holding capacity 708 on the side connected to the gate electrode of the drive TFT 707, so that the drive TFT 707 is rendered nonconductive. Namely, the constitution may be such that the gate electrode of the drive TFT 707 is connected, via the erasing TFT 501, to a wiring to which is input a signal of a potential which renders the drive TFT 707 to be nonconductive.

Instead of the constitution of the type in which the above erasing TFT 501 is rendered conductive to change the potential of the holding capacitor 708 on the side connected to the gate electrode of the drive TFT 707, the constitution may be such that the erasing TFT is arranged in series with the drive TFT 707 and the non-display period is obtained by rendering the erasing TFT to be nonconductive.

It is further possible to put the pixels to the state of not emitting light at one time, i.e., to form the non-display period without using the erasing TFT irrespective of the signal on the gate signal line or the signal (video signal) on the source signal line.

For example, there is a method of rendering the drive TFT 707 to be nonconductive by raising or lowering the potential of one of the two electrodes of the holding capacitor 708 on the side that is not connected to the gate electrode of the drive TFT 707. When the drive TFT 707 is of the P-channel type, the potential of the holding capacitor 708 on the side that is not connected to the drive TFT 707 is raised. Since the electric charge held by the holding capacitor 708 remains constant, another potential of the holding capacitor 708 increases to render the drive TFT 707 nonconductive. Thus, the non-display period Tus is formed.

As another method, the potentials of the opposing electrodes of EL elements 709 in all pixels are changed at one time to change over the light emitting/non-emitting state of the EL elements 709 in all pixels at one time. According to this method, the potential of the opposing electrode is maintained to be nearly the same as the potential of the power line W in each address period Ta in the sub-frame periods. When the address period Ta ends, the potential of the opposing electrode so changes as to possess a predetermined potential difference relative to the power line W. At this moment, a current flows into the EL elements 709 in the pixels for which the light-emitting state is selected from the power line W through the drive TFTs 707 to emit light. The display period Ts thus starts. The timing of the display period Ts is the same in all pixels. After the display period Ts of a predetermined length, the potential of the opposing electrode of the EL element 709 is changed again in the same manner as the potential of the power line W to put, at one time, all of the pixels to the state of not emitting light. The non-display period Tus is thus formed. The timing of the non-display period Tus is the same in all pixels.

Embodiment 3

Figure 8A:
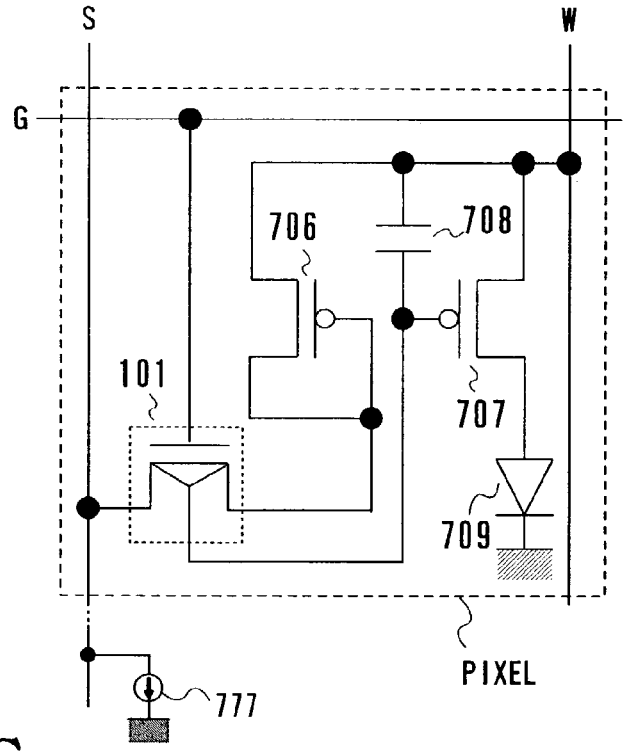
FIG. 8A and FIG. 8B are diagram illustrating the constitution of the pixel in the display device of the invention.
Figure 8B:
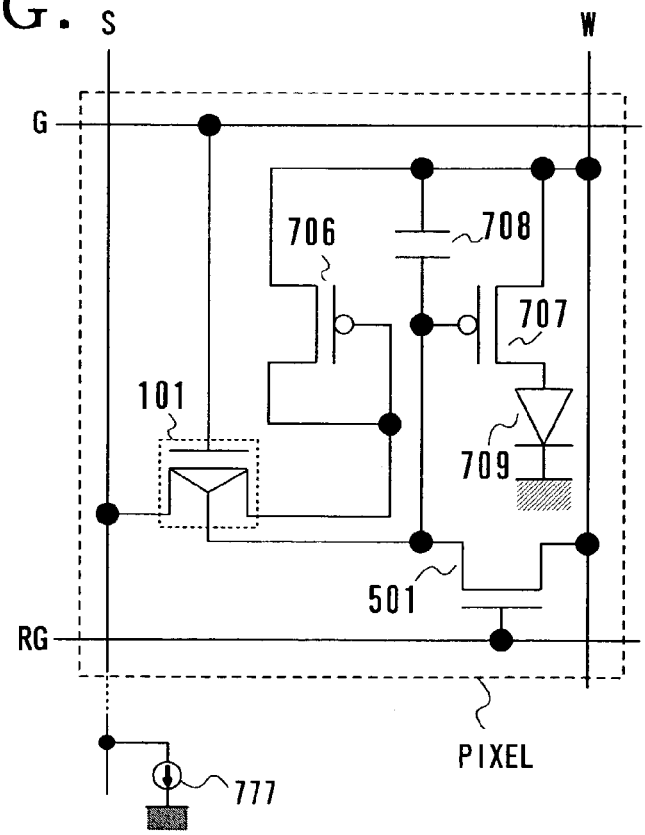
Figure 9:
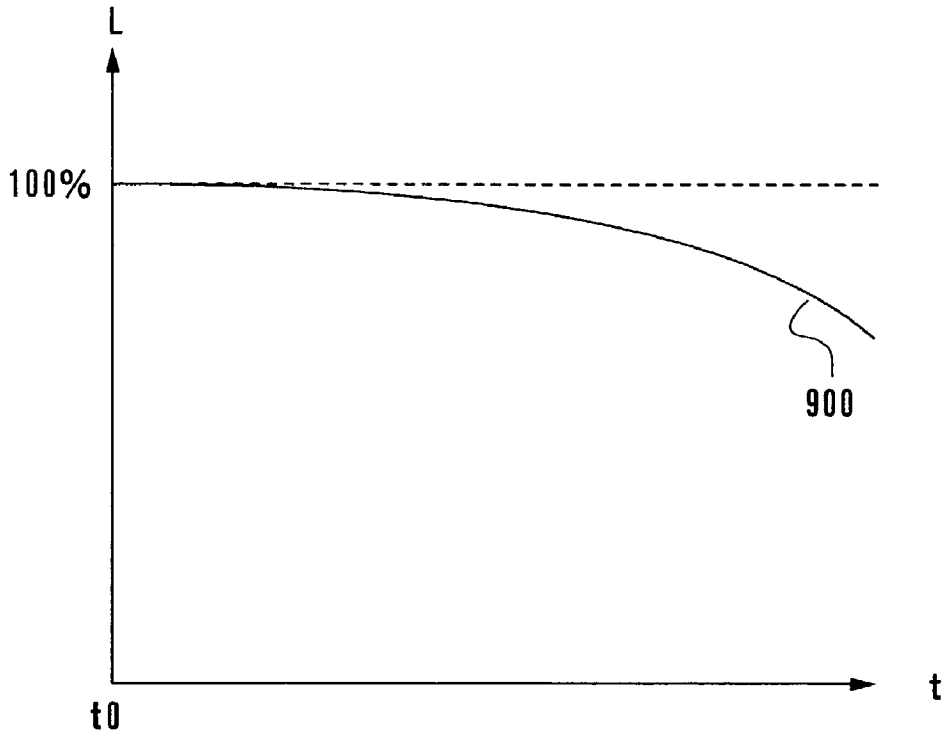
FIG. 9 is a diagram illustrating the deterioration in an EL element.

This embodiment deals with the pixels of a constitution different from those of the pixels illustrated in the embodiments 1 and 2. FIGS. 8A and 8B illustrate the constitution of the pixel according to the embodiment 3. In FIGS. 8A and 8B, the same portions as those of FIGS. 1A–B and 5 are denoted by the same reference numerals, but their description is not repeated. In FIGS. 8A and 8B, the drive TFT 707 and the current TFT 706 in the pixel are the P-channel transistors, and the pixel electrode is an anode.

In FIGS. 8A and 8B, the first terminal of the current TFT 706, the gate electrode of the drive TFT 707 and the source signal line S are connected to one of different terminals T1 to T3 of the multi-drain element 101. Further, the first terminal of the current TFT 706 is connected to the gate electrode, and the second terminal of the current TFT 706 is connected to the power line W. The first terminal of the drive TFT 707 is connected to one electrode (anode) of the EL element 709, and the second terminal of the drive TFT 707 is connected to the power line W. One electrode of the holding capacitor 708 is connected to the gate electrode of the drive TFT 707, and another electrode thereof is connected to the power line W. In FIG. 8B, further, there is provided an erasing TFT 501. The first terminal of the erasing TFT 501 is connected to the power line W, and the second terminal of the erasing TFT 501 is connected to one electrode of the holding capacitor 708.

In FIGS. 8A and 8B, the second terminal of the current TFT 706 and the second terminal of the drive TFT 707 are connected to the power line W, to which only, however, the pixel constitution of the invention is in no way limited. In general, the second terminal of the current TFT 706 and the second terminal of the drive TFT 707 may be so constituted as to assume the same potential when the drain current flows thereto.

Further, one of the two electrodes of the holding capacity 708 on the side that is not connected to the gate electrode of the drive TFT 707 is connected to the power line W, to which only, however, the pixel constitution of the invention is in no way limited. Between the two electrodes of the holding capacitor 708, in general, the one on the side that is not connected to the gate electrode of the drive TFT 707 may be so constituted as to assume a potential equal to the potential at the second terminals of the current TFT 706 and of the drive TFT 707 while the current is flowing into the current TFT 706 or the drive TFT 707.

In FIG. 8B, further, the first terminal of the erasing TFT 501 may be connected to a wiring which is separate from the power line W. Further, the erasing TFT 501 may be connected in series with the drive TFT 707.

Unlike FIG. 8, further, when the pixel electrode of the EL element is a cathode, it is desired that the potentials at the source terminals of the current TFT 706 and of the drive TFT 707 are fixed while the EL element emits light. It is therefore desired to use the N-channel TFTs as the current TFT 706 and the drive TFT 707.

The driving method is the same as the method illustrated in the Embodiments 1 and 2, and is not repeated here.

Embodiment 4

Figure 20A:
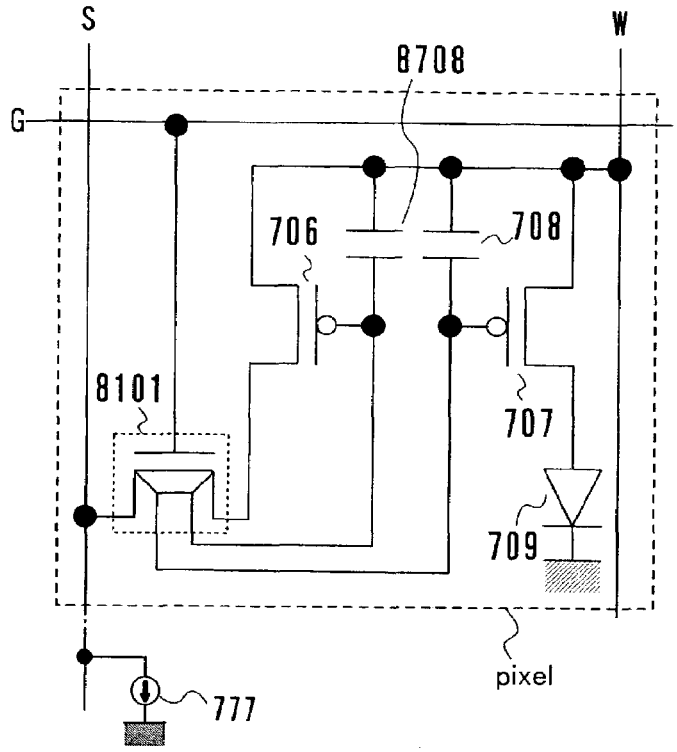
FIG. 20A and FIG. 20B are diagrams illustrating the constitutions of the pixels in the display device of the invention.
Figure 20B:
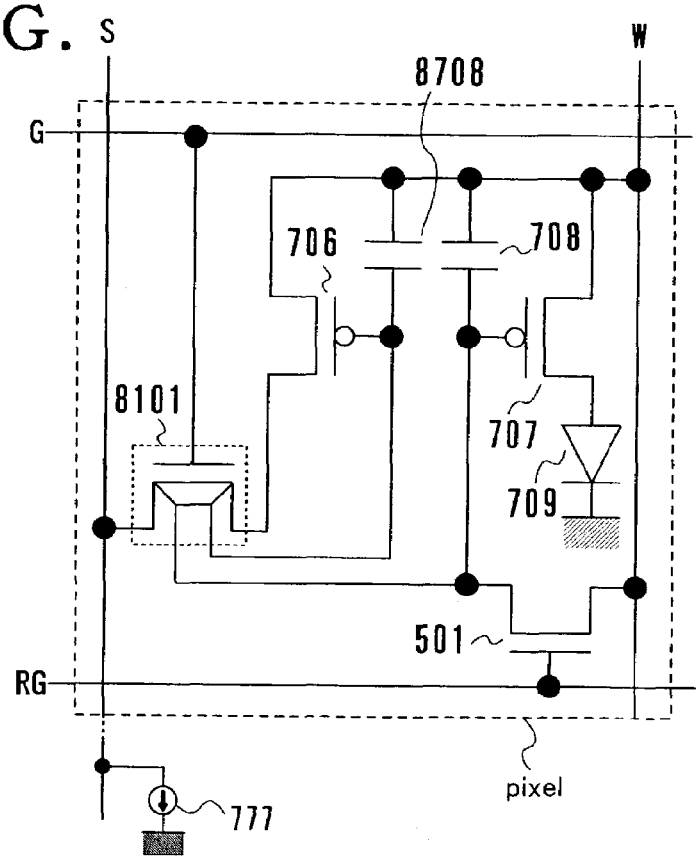

This embodiment deals with the pixels using the multi-drain element of a constitution different from the multi-drain element described in the embodiment 1. The description refers to FIGS. 20A–B and 21A–D. In FIGS. 20A–B, the same portions as those of FIGS. 8A–B are denoted by the same reference numerals, but their description is not repeated. FIGS. 20A–B employ a multi-drain element 8101 unlike that of FIGS. 8A–B. In response to a signal input to the gate signal line G, the multi-drain terminal 8101 connects the gate electrodes of current TFT 706 and of drive TFT 707 as well as the first terminal of current TFT 706 to the signal line S. One electrode of a holding capacitor 8708 is connected to the gate electrode of the current TFT 706. Another electrode of the holding capacitor 8708 is connected to the power line W. In contrast with FIG. 20A, an erasing TFT 501 is used in FIG. 20B. The pixel of the constitution shown in FIG. 20A is driven by the same method as that of the embodiment 1, which, therefore, is not described here again. Further, the pixel of the constitution shown in FIG. 20B is driven by the same method as that of the embodiment 2, which, therefore, is not described here again.

Figure 21A:
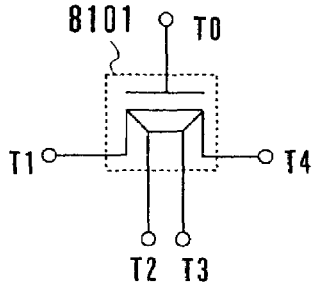
FIGS. 21A–21D are diagrams illustrating the constitutions of the multi-drain element possessed by the pixel in the display device of the invention.

The terminals of the multi-drain element 8101 will now be described with reference to FIG. 21A. Depending upon a signal potential input to the terminal T0, the multi-drain element 8101 selects a state where the terminal T1 up to the terminal T4 (between terminal T1 and terminal T2, between terminal T2 and terminal T3, between terminal T1 and terminal T3, between terminal 1 and terminal 4, between terminal 2 and terminal 4, and between terminal 3 and terminal 4) are opened and a state where they are short-circuited.

Figure 21B:
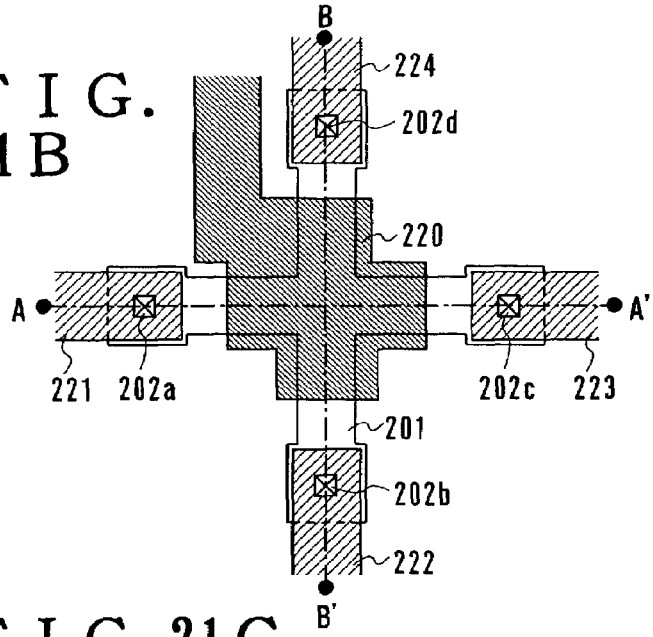
Figure 21C:
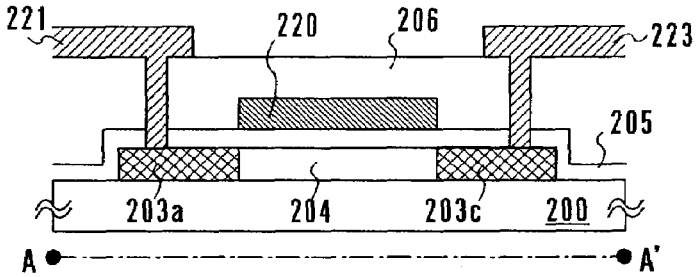
Figure 21D:
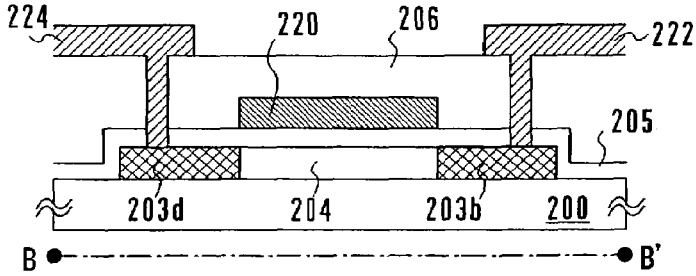

An example of fabricating the multi-drain element 8101 is illustrated in FIGS. 21B to 21D. FIG. 21C is a sectional view along the line A–A' in FIG. 21B, and FIG. 21D is a sectional view along the line B–B' in FIG. 21B. The same portions as those of FIGS. 2B to 2D are denoted by the same reference numerals but their description is not repeated. In FIG. 21B, there is formed a connection electrode 224 corresponding to one of the terminals T1 to T4 unlike that of FIG. 2B. The connection electrode 224 is connected to an impurity region 203*d* (see FIG. 21D) in the active layer 201 through a contact hole 202*d*.

Embodiment 5

This embodiment deals with the structure of the EL element arranged in the pixels in the display device of the invention. The EL layer may be made of an organic material or an inorganic material. Or, the EL layer may be made of both an organic material and an inorganic material.

The EL layer forming the EL element is not constructed in a stacked layer structure such as the one in which a positive hole injection layer made of a positive hole injection material, a positive hole transporting layer made of a positive hole transporting material, a light-emitting layer made of a light-emitting material, an electron transporting layer made of an electron transporting material and an electron injection layer made of an electron injection material, can be clearly distinguished. Instead, the EL layer is constituted by a layer (mixed layer) of a mixture of a plurality of materials such as the positive hole injection material, positive hole transporting material, light-emitting material, electron transporting material and electron injection material (hereinafter referred to as EL element of the mixed junction type).

FIGS. 14A–D and 15 are diagrams schematically illustrating the structure of an EL element of the mixed junction type. In FIGS. 14A–D and 15, reference numeral 1401 denotes an anode of the EL element, and 1402 denotes a cathode of the EL element. A layer held between the anode 1401 and the cathode 1402 corresponds to the EL layer.

Figure 14A:
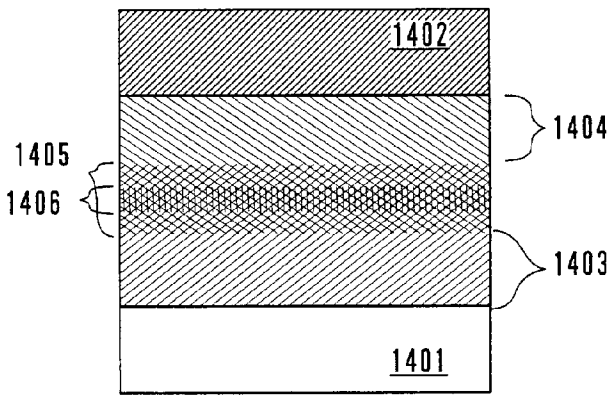
FIGS. 14A–D are diagrams schematically illustrating the constitutions of the EL element in the display device of the invention.

In FIG. 14A, the EL layer includes a positive hole transporting region 1403 made of a positive hole transporting material and an electron transporting region 1404 made of an electron transporting material, the positive hole transporting region 1403 being positioned closer to the anode side than the electron transporting region 1404. A mixed region 1405 containing both the positive hole transporting material and the electron transporting material is provided between the positive hole transporting region 1403 and the electron transporting region 1404.

Here, in a direction of from the anode 1401 to the cathode 1402, the concentration of the positive hole transporting material may decrease in the mixed region 1405 and the concentration of the electron transporting material may increase in the mixed region 1405.

The above constitution may not include the positive hole transporting region 1403 made of the positive hole transporting material only, but may be so constituted that the ratio of concentrations of the positive hole transporting material and the electron transporting material changes in the mixed region 1405 which contains both of them (has a gradient of concentration). Or, the above constitution may include neither the positive hole transporting region 1403 made of the positive hole transporting material only nor the electron transporting region 1404 made of the electron transporting material only, but may be so constituted that the ratio of concentrations of the positive hole transporting material and the electron transporting material changes in the mixed region 1405 which contains both of them (has a gradient of concentration). Or, the ratio of concentrations may vary depending upon the distances from the anode and the cathode. Further, the ratio of concentrations may vary continuously. The gradient of concentration can be freely set.

The mixed region 1405 includes a region 1406 to where a light-emitting material is added. The light-emitting material controls the color of light emitted from the EL element. Besides, the carriers can be trapped by the light-emitting material. As the light-emitting material, there can be used a metal complex containing a quinoline skeleton, a metal complex containing a benzoxazole skeleton, a metal complex containing a benzothiazole skeleton, and any other fluorescent coloring materials. Addition of these light-emitting materials makes it possible to control the color of light emitted by the EL element.

As the anode 1401, it is desired to use an electrode material having a large work function from the standpoint of efficiently injecting the positive holes. There can be used a transparent electrode such as tin-doped indium oxide (ITO), zinc-doped indium oxide (IZO), ZnO, $SnO_2$ or $In_2O_3$. If light needs not be transmitted, the anode 1401 may be made of an opaque metal material.

As the positive hole transporting material, further, there can be used an aromatic amine compound. As the electron transporting material, there can be used a metal complex with a quinoline derivative, a 8-quinolinol or a derivative thereof as a ligand (particularly, tris(8-quinolinolite)aluminum ($Alq_3$, etc.

As the cathode 1402, it is desired to use an electrode material having a small work function from the standpoint of efficiently injecting the electrons. There can be used a metal such as aluminum, indium, magnesium, silver, calcium, barium or lithium in one kind. Or, there may be used an alloy of these metals or an alloy of these metals with any other metals.

Figure 14B:
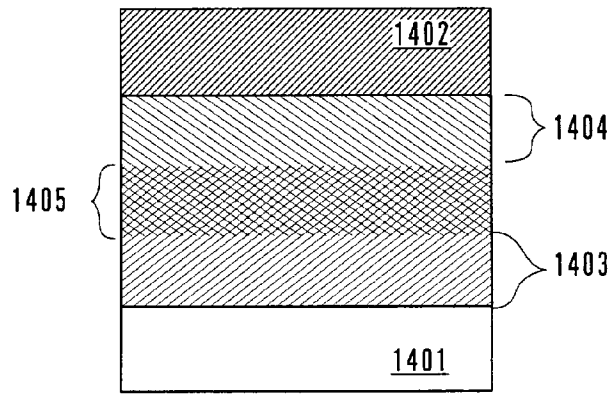

FIG. 14B is a schematic diagram of the EL element of a constitution different from FIG. 14A. The same portions as those of FIG. 14A are denoted by the same reference numerals but their description is not repeated. FIG. 14B does not have a region to where the light-emitting material is added. Here, however, a material (electron transporting light-emitting material) having both the electron transporting property and the light-emitting property, such as tris(8-quinolinolite)aluminum ($Alq_3$ may be added to the electron transporting region 1404 to emit light.

Or, a material (positive hole transporting light-emitting material) having both the positive hole transporting property and the light-emitting property may be added to the positive hole transporting region 1403.

Figure 14C:
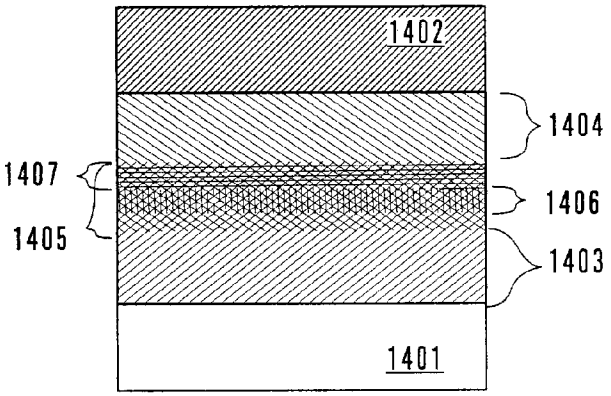

FIG. 14C is a schematic diagram of the EL element of a constitution different from FIGS. 14A and 14B. The same portions as those of FIGS. 14A and 14B are denoted by the same reference numerals but their description is not repeated. In FIG. 14C, the mixed region 1405 includes a region 1407 to where is added a positive hole-blocking material having an energy gap between a maximum occupied molecular trajectory and a minimum empty molecular trajectory, which is larger than that of the positive hole transporting material. The region 1407 to where the positive hole-blocking material is added is arranged on the side closer to the cathode 1402 than the region 1406 to where the light-emitting material is added in the mixed region 1405, in order to increase the recombination coefficient of carriers and, hence, to improve the light-emitting efficiency. Provision of the region 1407 to where the positive hole-blocking material is added is effective, particularly, for the EL element that utilizes the emission of light (phosphorescence) by the triplet excitons.

Figure 14D:
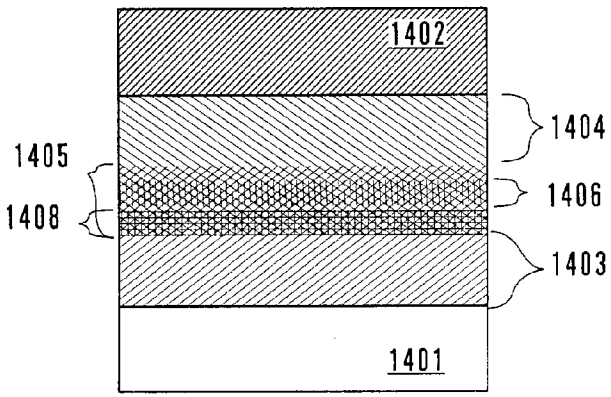

FIG. 14D is a schematic diagram of the EL element of a constitution different from FIGS. 14A, 14B and 14C. The same portions as those of FIGS. 14A, 14B and 14C are denoted by the same reference numerals but their description is not repeated. In FIG. 14D, the mixed region 1405 includes a region 1408 to where is added an electron-blocking material having an energy gap between a maximum occupied molecular trajectory and a minimum empty molecular trajectory, which is larger than that of the electron transporting material. The region 1408 to where the electron-blocking material is added is arranged on the side closer to the anode 1401 than the region 1406 to where the light-emitting material is added in the mixed region 1405, in order to increase the recombination coefficient of carriers and, hence, to improve the light-emitting efficiency. Provision of the region 1408 to where the electron-blocking material is added is effective, particularly, for the EL element that utilizes the emission of light (phosphorescence) by the triplet excitons.

The mixed junction type EL elements illustrated in FIGS. 14A to 14D have no explicit interfaces of layers, and accumulate the electric charge in decreased amounts. Accordingly, the life can be extended and, besides, the drive voltage can be lowered.

The EL element of the mixed junction type can be fabricated by the co-vaporization method.

The constitutions illustrated in FIGS. 14A to 14D can be put into practice in free combinations. The constitutions of the EL element of the mixed junction type are not limited thereto only, and any known constitution can be freely used.

This embodiment can be put into practice in free combination with the embodiments 1 to 4. Namely, the EL element of the mixed junction type of this embodiment can be employed for the pixels of constitutions that employ multi-drain elements of embodiments 1 to 4. This further decreases the deterioration in the EL elements.

Embodiment 6

Figure 15:
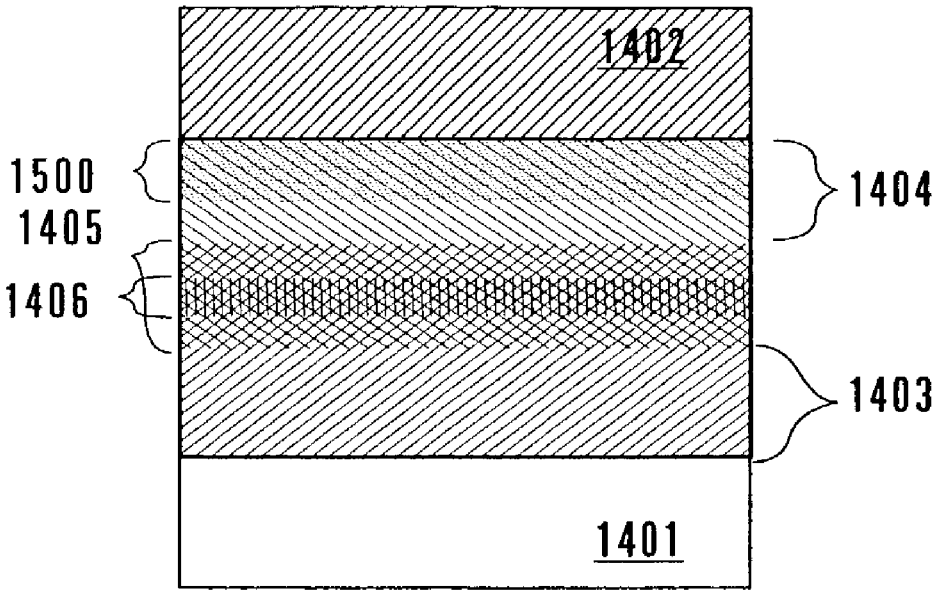
FIG. 15 is a diagram schematically illustrating the constitution of the EL element in the display device of the invention.

This embodiment deals with the EL element of a constitution different from the embodiment 5. FIG. 15 is a schematic diagram illustrating the constitution of the EL element of the mixed junction type different from those of FIGS. 14A–D. FIG. 15 illustrates a constitution in which a metal material is added to a portion of the EL layer which is in contact with the electrode of the EL element. In FIG. 15, the same portions as those of FIGS. 14A–D are denoted by the same reference numerals but their description is not repeated. The constitution is such that MgAg (Mg—Ag alloy) is used as the cathode 1401, and an Al (aluminum) alloy is added to a portion of the region 1404 to where the electron transporting material has been added, that comes in contact with the cathode 1402. The above constitution prevents the cathode from oxidizing, and enhances the efficiency for injecting the electrons from the cathode. Thus, the mixed junction type EL element features an extended life. Besides, the drive voltage can be lowered.

The constitution of the EL element of the mixed junction type is not limited thereto only, and any known constitution can be freely used.

This embodiment can be put into practice in free combination with the embodiments 1 to 4. Namely, the EL element of the mixed junction type of this embodiment can be employed for the pixels of constitutions that employ multi-drain elements of embodiments 1 to 4. This further decreases the deterioration in the EL elements.

Embodiment 7

Figure 16:
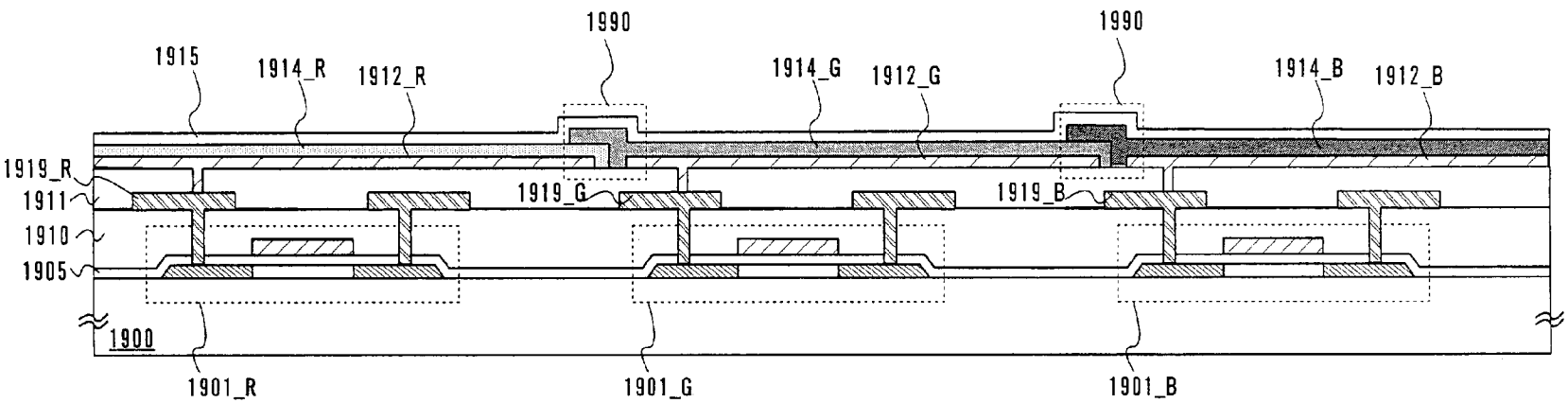
FIG. 16 is a sectional view illustrating the constitution of the pixel unit in the display device of the invention.

This embodiment deals with a constitution for dividing the EL elements of the pixels in the display device of the invention into separate colors. FIG. 16 is a sectional view of pixels in the EL display device according to this embodiment. Only three pixels of the EL display device are representatively illustrated here. As the elements constituting these pixels, there are shown only the EL elements and the TFTs connected to the pixel electrodes of the EL elements. The TFTs connected in series with the EL elements may be drive TFTs 707 shown in FIGS. 1A–B and 5.

In FIG. 16, there are formed TFTs 1901-R, 1901-G and 1901-B on a pixel substrate 1900. In this embodiment, the TFTs 1901-R, 1901-G and 1901-B may be, respectively, the drive TFTs 707 shown in FIGS. 1A–B and 5.

The drive TFTs 1901-R, 1901-G and 1901-B are not limited to the illustrated constitution only but may be freely constituted in a known manner. In FIG. 16, for example, the drive TFTs 1901-R, 1901-G and 1901-B are the single-gate TFTs. However, they may be the multi-gate TFFs. In FIG. 16, further, the drive TFTs 1901-R, 1901-G and 1901-B are the top-gate TFTs. They, however, may be the bottom-gate TFTs. Or, they may be the dual-gate TFTs having two gate electrodes arranged over and under the channel-forming region via the gate-insulating films.

A first interlayer film 1910 is formed on the drive TFTs 1901-R, 1901-G and 1901-B. Contact holes are formed in the first interlayer film 1910 so as to reach the source regions or the drain regions of the drive TFTs 1901-R, 1901-G and 1901-B, and a wiring layer is formed followed by patterning into a desired shape to form wirings 1919-R, 1919-G and 1919-B. A second interlayer film 1911 is formed on the wirings 1919-R, 1919-G and 1919-B. Next, contact holes are formed in the second interlayer film 1911 so as to reach the wirings 1919-R, 1919-G and 1919-B thereby to form pixel electrodes 1912-R, 1912-G and 1912-B.

Here, the second interlayer film 1911 may not be formed. Namely, the pixel electrodes 1912-R, 1912-G and 1912-B may be formed on the same layer as the wirings 1919-R, 1919-G and 1919-B.

Then, a red light-emitting layer 1914-R, a green light-emitting EL layer 1914-G and a blue light-emitting EL layer 1914-B are successively formed. Thereafter, an opposing electrode 1915 of the EL element 1614 is formed. Thus, a red light-emitting EL element is formed by the pixel electrode 1912-R, red light-emitting EL layer 1914-R and opposing electrode 1915. A green light-emitting EL element is formed by the pixel electrode 1912-G, green light-emitting EL layer 1914-G and opposing electrode 1915. A blue light-emitting EL element is formed by the pixel electrode 1912-B, blue light-emitting EL layer 1914-B and opposing electrode 1915.

In forming the EL layers 1914-R, 1914-G and 1914-B (dividing into separate colors), the EL layers 1914-R, 1914-G and 1914-B are overlapped at their boundaries (ends) 1990. The above constitution requires no bank that was so far formed by using the insulating film for dividing the EL layers corresponding to the colors of emitted light into separate colors. Accordingly, the EL layers are divided into separate colors requiring a small margin making it possible to increase the areas of the light-emitting regions in the pixels.

In the pixels corresponding to three colors of red, blue and green in FIG. 16, the ends of the EL layers of EL elements are arranged being overlapped, to which only, however, the constitution of the display device of the invention is not limited. The above constitution can be applied to the pixels corresponding to any number of colors of emitted light.

This embodiment can be carried out in free combination with the embodiments 1 to 6. Namely, in the pixels of the constitutions using multi-drain elements of the embodiments 1 to 4, the EL layers of the EL elements may be arranged being overlapped at their ends. This further enhances the numerical aperture and decreases the deterioration of the EL elements. In the pixels having the mixed junction type EL elements of the embodiments 5 and 6, too, the EL layers of the EL elements may be arranged being overlapped at their ends. This further enhances the numerical aperture and decreases the deterioration of the EL elements. In the pixels using the multi-drain elements of the embodiments 1 to 4 and, further, in the pixels having the mixed junction type EL elements of the embodiments 5 and 6, too, the EL layers of the EL elements may be arranged being overlapped at their ends. This further enhances the numerical aperture and decreases the deterioration of the EL elements.

Embodiment 8

This embodiment deals with the structure of the EL element arranged in the pixels of the display device of the invention.

The organic material constituting the EL layer of the EL elements may be either a low-molecular material or a high-molecular material. Or, both of these materials may be used. When the low-molecular material is used as the organic compound material, a film can be formed by a vaporization method. When the high-molecular material is used as the EL layer, on the other hand, the high-molecular material may be dissolved in a solvent to form the film by a spin-coating method or an ink-jet method.

Further, the EL layer may be constituted by an intermediate-molecular material. The intermediate-molecular material stands for an organic material which does not sublime and has a polymerization degree of not larger than about 20. When the intermediate-molecular material is used as the EL layer, the film can be formed by the ink-jet method or the like method.

It is also allowable to use the low-molecular material, high-molecular material and intermediate-molecular material in combination.

Further, the EL element may be either the one that utilizes the emission of light (fluorescence) from the singlet oxcitons or the one that utilizes the emission of light (phosphorescence) from the triplet excitons.

This embodiment can be put into practice in free combination with the embodiments 1 to 7.

Embodiment 9

This embodiment illustrates, with reference to FIGS. 13A–D, the fabrication of a multi-drain element of a constitution different from the constitution of the multi-drain element of the embodiment 1 shown in FIGS. 2A–D. In FIGS. 13A–D, the same portions as those of FIGS. 2A–D are denoted by the same reference numerals but their description is not repeated.

Figure 13A:
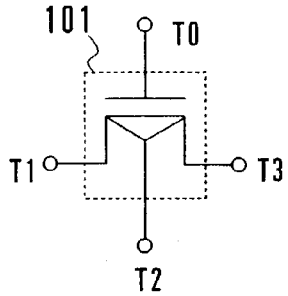
FIGS. 13A–D are diagrams illustrating the constitutions of the multi-drain element possessed by the pixel in the display device of the invention.
Figure 13B:
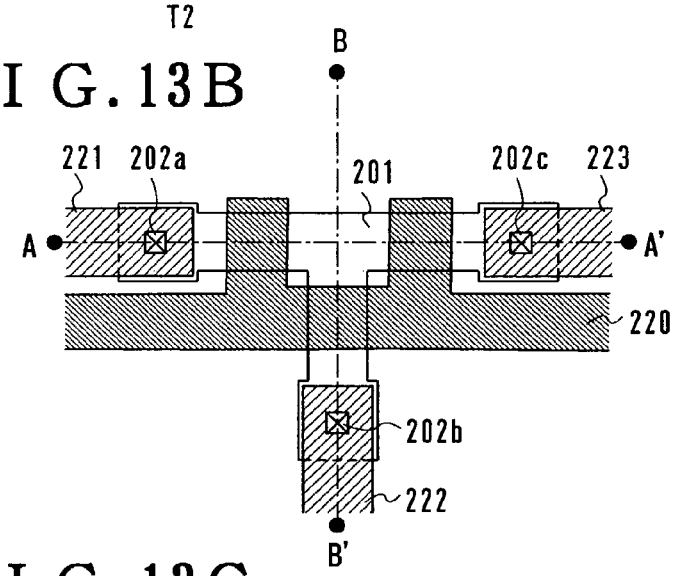
Figure 13C:
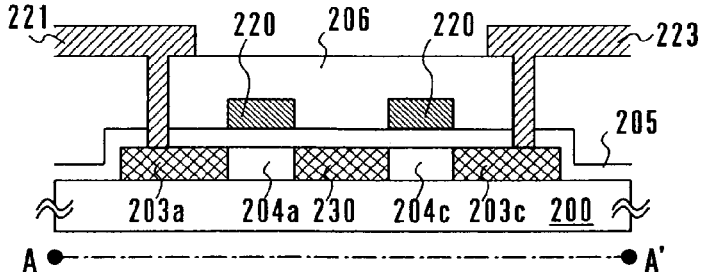
Figure 13D:
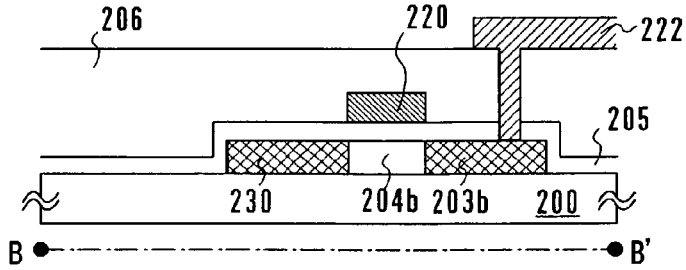

FIG. 13A shows a symbol of the multi-drain element. FIG. 13B is a top view of when the multi-drain element shown in FIG. 13A is fabricated. FIG. 13C is a sectional view along the line A–A' in FIG. 13B. FIG. 13D is a sectional view along the line B–B' in FIG. 13B.

In FIGS. 13C and 13D, the active layer 201 formed on a substrate 200 having an insulating surface includes impurity regions 203*a*, 203*b*, 203*c* and 230 to where are added impurities that impart the same time of electric conduction, and channel regions 204*a*, 204*b* and 204*c*. The electrode 220 is overlapped on the channel-forming regions 204*a*, 204*b* and 204*c* via a gate-insulating film 205. The connection electrodes 221 to 223 are formed on an insulating film 206 formed on the electrode 220, and are electrically connected to the impurity regions 203*a*, 203*b* and 203*c* through contact holes 202*a* to 202*c*. The electrode 220 corresponds to the terminal T0 in FIG. 13A. The shape of the electrode 220 in FIGS. 13A–D is different from the shape of the electrode 220 in FIGS. 2A–D. Further, the connection electrode 221 corresponds to the terminal T1, the connection electrode 222 corresponds to the terminal T2, and the connection electrode 223 corresponds to the terminal T3.

Further, the connection electrode 221 may correspond to the terminal T2, the connection electrode 222 may correspond to the terminal T3, and the connection electrode 223 may correspond to the terminal T1. Or, the connection electrode 221 may correspond to the terminal T3, the connection electrode 222 may correspond to the terminal T1, and the connection electrode 223 may correspond to the terminal T2.

The impurity regions 203*a*, 203*b*, 203*c* and 230 are in contact with one of, or with all of, the three channel-forming regions 204*a*, 204*b* and 204*c*. In this embodiment, the impurity regions are all in direct contact with the channel-forming regions, to which only, however, the invention is in no way limited. A low-concentration impurity region (LDD region) having an impurity concentration lower than that of the impurity regions may be provided between the impurity regions 203*a*, 203*b*, 203*c* and 230 and the channel-forming regions 204*a*, 204*b*, 204*c*.

In FIGS. 13C and 13D, the gate-insulating film 205 is covering the impurity regions 203*a*, 203*b*, 203*c* and 230, to which only, however, the invention is in no way limited. The impurity regions 203*a*, 203*b*, 203*c* and 230 need not necessarily be covered with the gate-insulating film 205 but may be exposed.

The multi-drain element 101 can be fabricated through a process which is the same as the one for fabricating the normal TFTs. In FIGS. 13C and 13D, the electrode 220 of the multi-drain element 101 of the invention can be made of a material which is the same as that of the gate electrode of the known TFTs. Further, the channel-forming regions 204*a*, 204*b*, 204*c* and the impurity regions 203*a*, 203*b*, 203*c* and 230 can be formed in the active layer 201 in the same manner as that of the conventional TFTs.

Here, a portion of the electrode 220 that overlaps the active layer 201 is also called gate electrode of the multi-drain element. The impurity regions 203*a* to 203*c* to where the terminals T1 to T3 of the multi-drain terminal are connected are called source regions or drain regions, respectively. Further, the terminals T1 to T3 of the multi-drain element are also called source terminals or drain terminals.

Depending upon a potential applied to the electrode (gate electrode) 220, the multi-drain element 101 shown in FIGS. 13A–D changes its channels formed in the channel-forming regions 204*a*, 204*b*, 204*c* and is controlled for its resistance among the terminals T1 to T3 (corresponds to between the source terminal and the drain terminal). Namely, due to the potential at the gate electrode 220, a channel is formed in the channel-forming region, and a passage between the source terminal and the drain terminal is rendered conductive.

In FIGS. 13A–D, for example, an impurity element for imparting the N-type is added to the impurity regions 203*a*, 203*b*, 203*c* and 230 in the multi-drain element 101. In this case, the potential at the gate electrode T0 is set to be sufficiently higher than the potential in the source region that corresponds to any one or two of the impurity regions 203*a*, 203*b* and 203*c*. Thus, the terminal T1 up to the terminal T3 can be short-circuited. The thus constituted multi-drain element 101 is called N-channel multi-drain element.

In FIGS. 13A–D, on the other hand, an impurity element for imparting the P-type is added to the impurity regions 203*a*, 203*b*, 203*c* and 230 in the multi-drain element 101. In this case, the potential at the gate electrode T0 is set to be sufficiently lower than the potential in the source region that corresponds to any one or two of the impurity regions 203*a*, 203*b* and 203*c*. Thus, the terminal T1 up to the terminal T3 can be short-circuited. The thus constituted multi-drain element is called P-channel multi-drain element.

Thus, the multi-drain element 101 of FIG. 13A is capable of simultaneously connecting three nodes or, concretely, simultaneously connecting the terminals T1 up to T3.

This embodiment can be put into practice in free combination with the embodiments 1 to 9. Namely, the multi-drain element of the constitution of this embodiment can be used instead of the multi-drain elements of the embodiments 1 to 4. Further, the multi-drain element of this embodiment can be used for the pixels having the mixed junction type EL elements of the embodiments 5 and 6. This further increases the numerical aperture and decreases the deterioration in the EL elements. It is further allowable to employ a constitution in which the EL layers of the EL elements are overlapped at their ends. This further increases the numerical aperture and decreases the deterioration in the EL elements.

Embodiment 10

In this embodiment, a reverse bias applied to the EL element at regular intervals to suppress the deterioration. FIGS. 17A–C, 18A–C, 19A and 19B and illustrate constitutions of pixels employing the above drive method. In FIGS. 17A–C and 18A–C, the same portions as those of FIG. 1A are denoted by the same reference numerals but their description is not repeated. In FIGS. 19A and 19B, further, the same portions as those of FIGS. 20A and 20B are denoted by the same reference numerals. Here, the pixel electrode is an anode and the opposing electrode is a cathode.

Figure 17A:
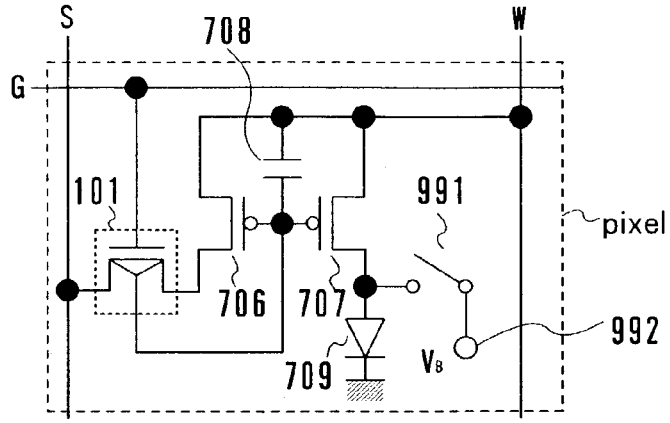
FIGS. 17A–C are diagrams illustrating the constitutions of the pixel in the display device of the invention.

In FIG. 17A, a terminal 992 is connected to the pixel electrode of an EL element 709 through a switch 991. Here, a potential $V_B$ at the terminal 992 is set to be smaller than a potential at the opposing electrode of the EL element 709. Upon turning the switch 991 on, the potential at the pixel electrode of the EL element 709 becomes smaller than the potential at the opposing electrode. Thus, a reverse bias is applied to the EL element 709.

Next, described below is a drive method at the time of applying a reverse bias to the pixel of the constitution of FIG. 17A. For example, described below is a case where there is employed a time division gray scale system illustrated in the embodiment 1. The operation for applying a reverse bias can be conducted during a period in which the pixel is not displaying. For example, the pixel display is temporarily interrupted, the switch 991 is turned on, and a reverse bias is applied to the EL element 709. During the period where the pixel is displaying, the switch 991 remains turned off. The operations are the same as those of the embodiment 1 and are not described here again, except the operation of the switch 991 at the time of conducting the time division gray scale system.

Figure 18A:
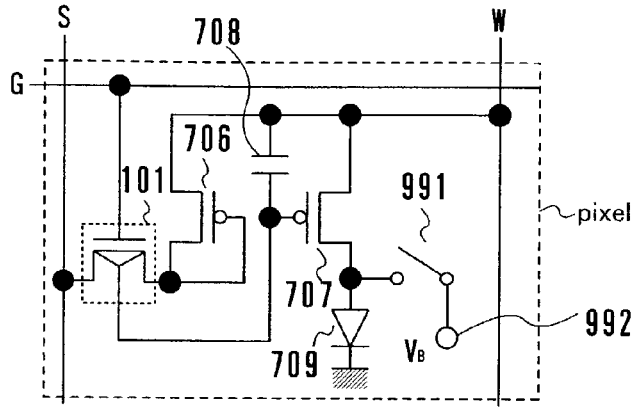
FIGS. 18A–C are diagrams illustrating the constitutions of the pixel in the display device of the invention.
Figure 19A:
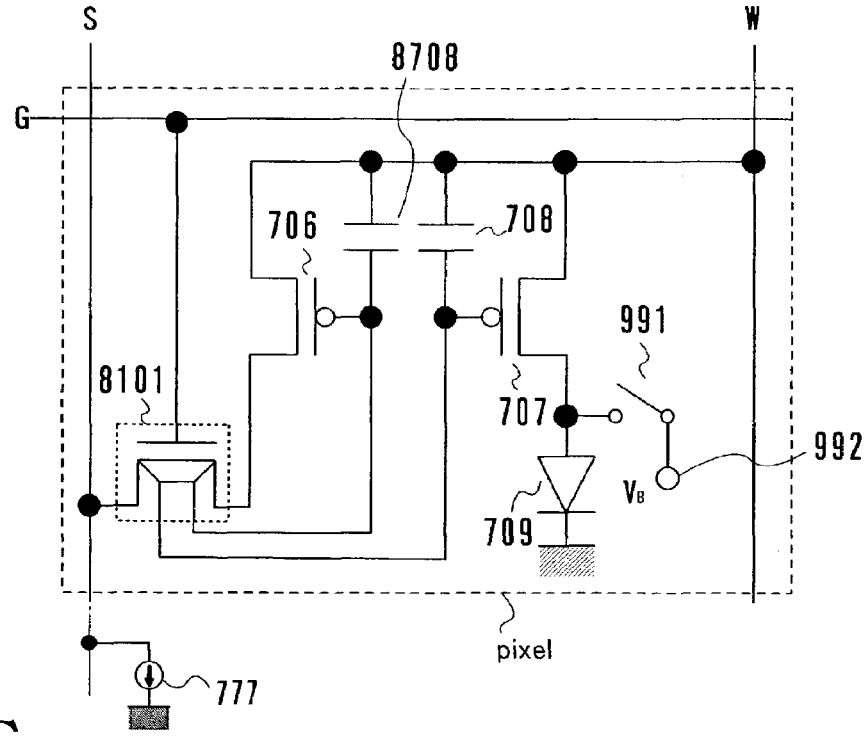
FIG. 19A and FIG. 19B are diagrams illustrating the constitutions of the pixels in the display device of the invention.
Figure 19B:
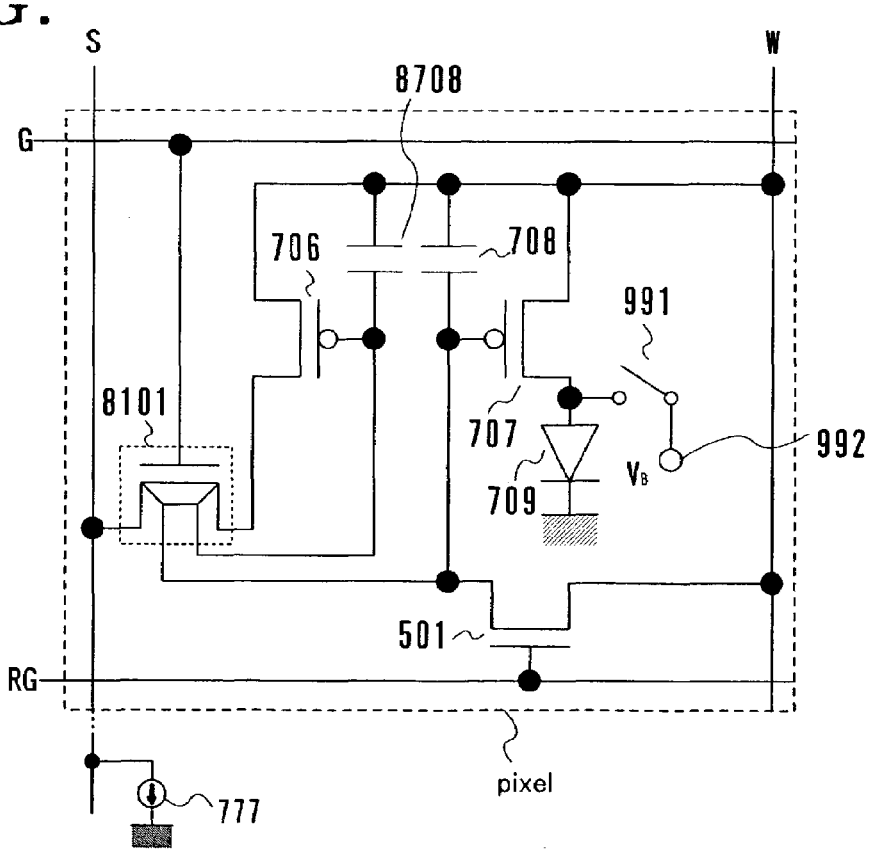

Similarly, the operation for applying a reverse bias can also be effected for the pixels of constitutions of FIGS. 18A, 19A and 20A.

Figure 17B:
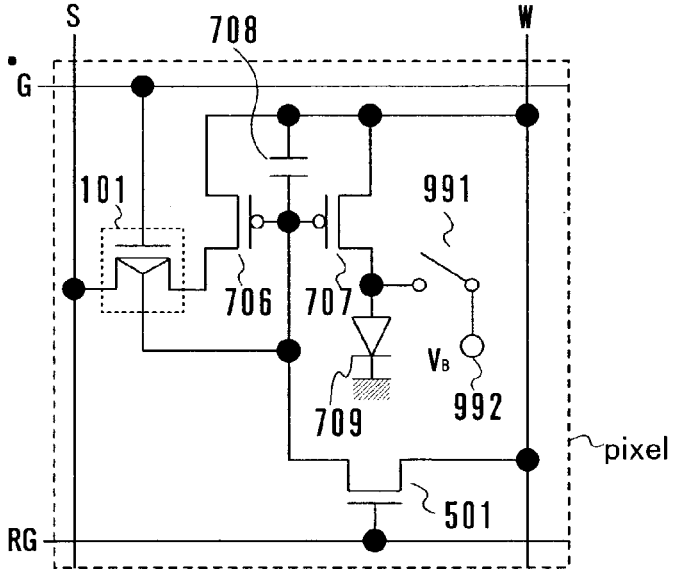

The constitution of the pixel shown in FIG. 17A may further include an erasing transistor. This constitution is shown in FIG. 17B. The same portions as those of FIG. 17A are denoted by the same reference numerals.

Described below is a driving method while applying a reverse bias in the pixel constitution shown in FIG. 17B. Described below is when the time division gray scale system described in the embodiment 2 is used. The operation for applying a reverse bias can be conducted during a period in which the pixel is not displaying. For instance, the reverse bias can be applied to the EL element 709 during the non-display period. During the display period, the switch 991 remains turned off. The operations are the same as those of the embodiment 2 and are not described here again, except the operation of the switch 991 at the time of conducting the time division gray scale system.

Figure 18B:
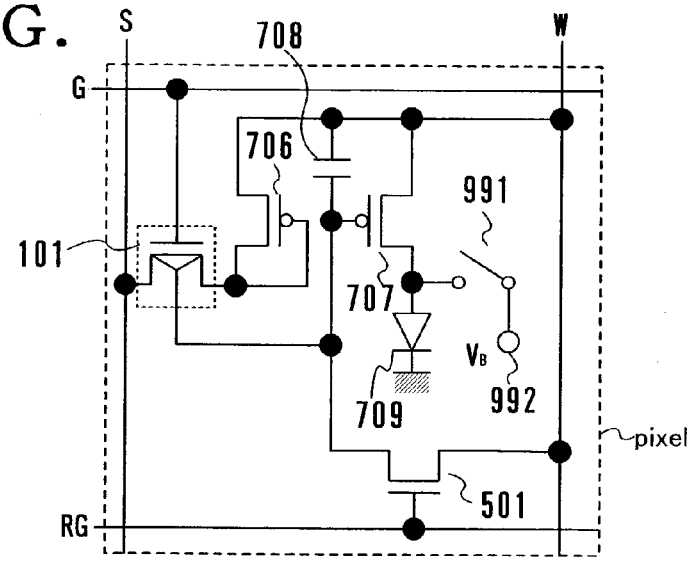

Similarly, the operation for applying a reverse bias can also be effected for the pixels of constitutions of FIGS. 18B, 19B and 20B.

Figure 17C:
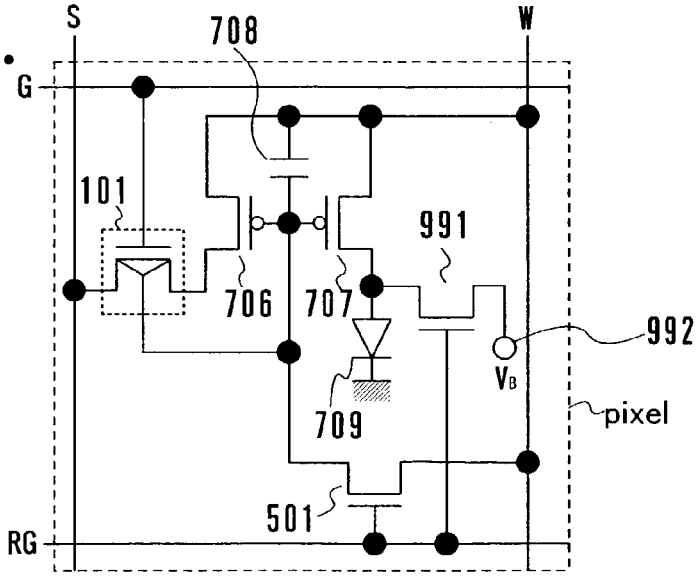

FIG. 17C shows an example of when a TFT is used as the switch 991 in the constitution of FIG. 17B. Here, the time division gray scale display can be conducted relying upon the driving method of applying a reverse bias during the non-display period. For this purpose, the switch 991 is so operated as to be turned on when the erasing TFT 501 is being turned on. Here, the signal input to the gate electrode of the switch 991 may be the same as the signal (on the erasing gate signal line RG) input to the gate electrode of the erasing TFT 501.

Figure 18C:
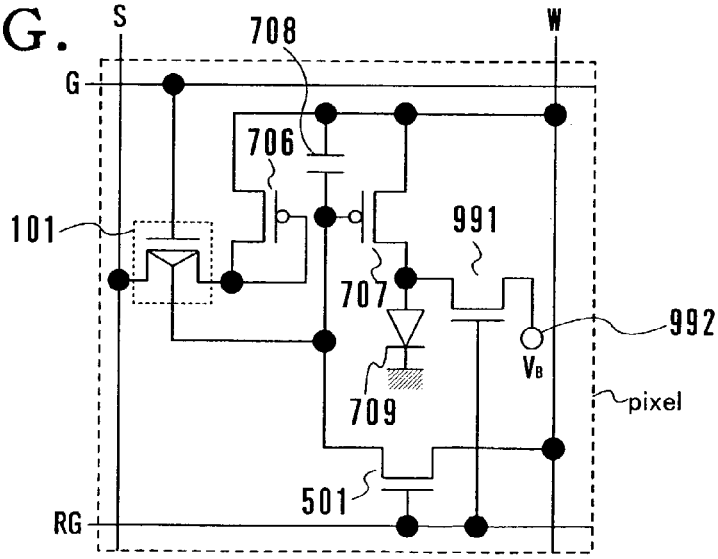

Similarly, the operation for applying a reverse bias can also be effected for the pixels of the constitution of FIG. 18C.

The above constitution suppresses the deterioration in the EL elements in the pixels.

This embodiment can be conducted in free combination with the embodiments 1 to 9. Namely, the constitution for applying a reverse bias to the EL element, can be applied to the multi-drain elements of the embodiments 1 to 4. This further decreases the deterioration in the EL elements. Further, the constitution for applying a reverse bias to the EL element, can also be applied to the pixels having the mixed junction type EL elements of the embodiments 5 and 6. This further decreases the deterioration in the EL elements. There can be further employed a constitution in which the EL layers of the EL elements are arranged being overlapped at their ends. This further increases the numerical aperture and decreases the deterioration in the EL elements.

Embodiment 11

This embodiment can be applied to a display system having a display device. Here, the display system includes a memory for storing video signals input to the display device, a controller for producing control signals (clock pulses, start pulse and the like pulses) input to the drive circuits of the display device, and a CPU for controlling the memory and the controller.

Further, the display device of the invention can be applied to a variety of electronic devices. Electronic devices fabricated by using the invention may include devices equipped with a display which reproduces a recording medium and displays the images thereof, such as video cameras, digital cameras, goggle-type displays (head mount displays), navigation systems, acoustic reproduction devices (car audio, audio components, etc.), notebook type personal computers, game devices, portable data terminals (mobile computers, cell phones, portable game devices, electronic books), image reproducing devices equipped with a record medium (concretely, digital versatile discs (DVDs), etc.

This embodiment can be put into practice in free combination with the embodiments 1 to 10.

Relying upon the above-mentioned constitution, the invention provides a display device capable of emitting light maintaining nearly a constant brightness while decreasing a change in the brightness caused by a change in the current characteristics stemming from deterioration in the EL elements.

What is claimed is:

1. A display device comprising:

a plurality of pixels and a plurality of signal lines to which current signals are input; and a multi-drain element, a first TFT, a capacitor element, an EL element that emits light, and a second TFT connected in series with the EL element in each of the plurality of pixels, wherein a gate electrode of the second TFT is connected to a gate electrode of the first TFT, wherein one electrode of the capacitor element is connected to the gate electrode of the first TFT, wherein the multi-drain element comprises an active layer adjacent to an insulating surface, an insulating film adjacent to the active layer and a gate electrode adjacent to the insulating film, and the active layer comprises at least one channel-forming region and impurity regions of a number of n (n is a natural number of not smaller than 3), wherein a first terminal of the first TFT, the gate electrode of the first TFT, and one of the plurality of signal lines are electrically connected to each of the impurity regions, respectively.

2. A display device according to claim 1, wherein:

the active layer is over the insulating surface;

the insulating film is over the active layer; and the gate electrode is overlapped over the active layer through the insulating film.

3. A display device according to claim 1, wherein each of the impurity regions contacts with the channel-forming region.

4. A display device according to claim 1, wherein the first terminal of the second TFT is connected to one electrode of the EL element and the second terminal of the first TFT and the second terminal of the second TFT are connected to the same wiring.

5. A display device according to claim 1, wherein:

the plurality of pixels include first pixels emitting light of a first color and second pixels emitting light of a color different from the first color; and ends of EL layers of the EL elements of the first pixels are overlapped on the ends of EL layers of the EL elements of the second pixels.

6. A display device according to claim 1, wherein the EL element has a first electrode, a second electrode and an EL layer held between the first electrode and the second electrode, and the EL layer has a mixed region to where both a first functional material and a second functional material having a function different from that of the first functional material are added.

7. A display device according to claim 6, wherein one of the first electrode and the second electrode of the EL element is an anode and the other one is a cathode, and means is provided to decrease the potential at the anode of the EL element to be lower than the potential at the cathode of the EL element.

8. A display device according to claim 1, wherein an EL layer of the EL element includes one or a plurality of a polymer, a low-molecular material and an intermediate-molecular material.

9. A display system having said display device according to claim 1.

10. An electronic device having said display device according to claim 1.

11. A display device comprising:

a plurality of pixels and a plurality of signal lines to which current signals are input; and a multi-drain element, a first TFT, a capacitor element, an EL element, and a second TFT connected in series with the EL element in each of the plurality of pixels, wherein a gate electrode of the second TFT is connected to a gate electrode of the first TFT, wherein one electrode of the capacitor element is connected to the gate electrode of the first TFT, wherein the multi-drain element comprises an active layer adjacent to an insulating surface, an insulating film adjacent to the active layer, and a gate electrode adjacent to the insulating film, and the active layer comprises at least one channel-forming region and impurity regions of a number of n (n is a natural number of not smaller than 3);

wherein a low-concentration impurity region whose concentration is lower than those of impurity regions is provided between each of the impurity regions of the number of n and the channel-forming region; and wherein the first terminal of the first TFT, the gate electrode of the first TFT, and one of the plurality of signal lines are electrically connected to each of the impurity regions, respectively.

12. A display device according to claim 11, wherein the active layer is over the insulating surface;

the insulating film is over the active layer; and the gate electrode is overlapped over the active layer through the insulating film.

13. A display device according to claim 11, wherein the first terminal of the second TFT is connected to one electrode of the EL element, and the second terminal of the first TFT and the second terminal of the second TFT are connected to the same wiring.

14. A display device according to claim 11, wherein;

the plurality of pixels include first pixels emitting light of a first color and second pixels emitting light of a color different from the first color; and ends of EL layers of the EL elements of the first pixels are overlapped on ends of the EL layers of the EL elements of the second pixels.

15. A display device according to claim 11, wherein the EL element has a first electrode, a second electrode and an EL layer held between the first electrode and the second electrode, and the EL layer has a mixed region to where both a first functional material and a second functional material having a function different from that of the first functional material are added.

16. A display device according to claim 15, wherein one of the first electrode and the second electrode of the EL element is an anode and the other one is a cathode, and means is provided to decrease the potential at the anode of the EL element to be lower than the potential at the cathode of the EL element.

17. A display device according to claim 11, wherein the EL layer of an EL, element includes one or a plurality of a polymer, a low-molecular material and an intermediate-molecular material.

18. A display system having said display device according to claim 11.

19. An electronic device having said display device according to claim 11.

20. A display device comprising:

a plurality of pixels and a plurality of signal lines to which current signals are input; and a multi-drain element, a first TFT, a capacitor element, an EL, element that emits light, and a second TFT connected in series with the EL element in each of the plurality of pixels, wherein one electrode of the capacitor element is connected to the gate electrode of the first TFT, wherein the multi-drain element comprises an active layer adjacent to an insulating surface, an insulating film adjacent to the active layer, and a gate electrode adjacent to the insulating film, and the active layer comprises at least one channel-forming region and impurity regions of a number of n (n is a natural number of not smaller than 3), wherein a first terminal of the first TFT, the gate electrode of the first TFT, and one of the plurality of signal lines are electrically connected to each of the impurity regions, respectively, and the gate electrode of the multi-drain element is connected to one signal of the plurality of signal lines.

21. A display device according to claim 20, wherein:

the active layer is over the insulating surface;

the insulating film is over the active layer; and the gate electrode is overlapped over the active layer through the insulating film.

22. A display device according to claim 20, wherein each of the impurity regions contacts with the channel-forming region.

23. A display device according to claim 20, wherein the first terminal of the second TFT is connected to one electrode of the EL element and the second terminal of the first TFT and the second terminal of the second TFT are connected to the same wiring.

24. A display device comprising:

a plurality of pixels and a plurality of signal lines to which current signals are input; and a multi-drain element a first TFT, a capacitor element, an EL element that emits light, and a second TFT connected in series with the EL element in each of the plurality of pixels, wherein a gate electrode of the second TFT is connected to a gate electrode of the first TFT, wherein one electrode of the capacitor element is connected to the gate electrode of the first TFT, wherein the multi-drain element comprises an active layer adjacent to an insulating surface, an insulating film adjacent to the active layer, and a gate electrode adjacent to the insulating film, and the active layer comprises at least one channel-forming region and impurity regions of a number of a (n is a natural number of not smaller than 3), wherein a first terminal of the first TFT, the gate electrode of the first TFT, and one of the plurality of signal lines are electrically connected to each of the impurity regions, respectively, and the gate electrode of the multi-drain element is connected to one signal of the plurality of signal lines.

25. A display device according to claim 24, wherein:

the active layer is over the insulating surface;

the insulating film is over the active layer; and the gate electrode is overlapped over the active layer trough the insulating film.

26. A display device according to claim 24, wherein each of the impurity regions contacts with the channel-forming region.

27. A display device according to claim 24, wherein the first terminal of the second TFT is connected to one electrode of the EL element, and the second terminal of the first TFT and the second terminal of the second TFT are connected to the same wiring.

* * * * *